US009962692B2

(12) United States Patent
Knight et al.

(10) Patent No.: US 9,962,692 B2
(45) Date of Patent: May 8, 2018

(54) METHODS, DEVICES, AND SYSTEMS FOR FLUID MIXING AND CHIP INTERFACE

(75) Inventors: Ivor T. Knight, Arlington, VA (US); Scott Corey, Hydes, MD (US); Ben Lane, Hydes, MD (US); Conrad Laskowski, Baltimore, MD (US); Alex Flamm, Baltimore, MD (US); Brian Murphy, Baltimore, MD (US)

(73) Assignee: Canon U.S. Life Sciences, Inc., Rockville, MD (US)

( * ) Notice: Subject to any disclaimer, the term of this patent is extended or adjusted under 35 U.S.C. 154(b) by 428 days.

(21) Appl. No.: 13/222,450

(22) Filed: Aug. 31, 2011

(65) Prior Publication Data

US 2012/0058571 A1 Mar. 8, 2012

Related U.S. Application Data

(60) Provisional application No. 61/378,722, filed on Aug. 31, 2010.

(51) Int. Cl.
*B01L 3/00* (2006.01)
*B01L 3/02* (2006.01)

(52) U.S. Cl.
CPC ..... *B01L 3/022* (2013.01); *B01L 3/5025* (2013.01); *B01L 3/502715* (2013.01);
(Continued)

(58) Field of Classification Search
CPC ..... G01N 1/00; B01L 3/02
(Continued)

(56) References Cited

U.S. PATENT DOCUMENTS 5,024,109 A * 6/1991 Romero ..... B01L 3/0227 422/926
5,174,162 A 12/1992 Miyake et al.
(Continued)

FOREIGN PATENT DOCUMENTS

JP H3-41363 A 2/1991
JP H6-174602 A 6/1994
(Continued)

OTHER PUBLICATIONS

PCT International Search Report and Written Opinion, issued in PCT/US11/49907 dated Mar. 26, 2012, 14 pages.
(Continued)

*Primary Examiner* — Christopher Adam Hixson
*Assistant Examiner* — Emily R. Berkeley
(74) *Attorney, Agent, or Firm* — Rothwell, Figg, Ernst & Manbeck, P.C.

(57) ABSTRACT

In one aspect, the present invention provides methods, devices, and systems for ensuring that multiple components of a mixture are fully mixed in a continuous flow microfluidic system while ensuring that mixing between segments flowing through the chip is minimized. In some embodiments, the present invention includes mixing fluids in a droplet maintained at the tip of a pipette before the mixture is introduced to the microfluidic device. In another aspect, the present invention provides a pipette tip having a ratio of an outside diameter to an inside diameter that provides sufficient surface area for a droplet comprising up to the entire volume of the liquid to suspend from the pipette tip intact. In yet another aspect, the present invention provides methods, devices, and systems for delivering a reaction mixture to a microfluidic chip comprising a docking receptacle, an access tube and a reservoir.

8 Claims, 20 Drawing Sheets

(52) U.S. Cl.
CPC . *B01L 2200/027* (2013.01); *B01L 2200/0642* (2013.01); *B01L 2200/10* (2013.01); *B01L 2300/14* (2013.01); *B01L 2400/0442* (2013.01); *B01L 2400/0487* (2013.01); *Y10T 436/2575* (2015.01)

(58) Field of Classification Search
USPC ..... 436/174, 180; 422/524
See application file for complete search history.

(56) References Cited

U.S. PATENT DOCUMENTS

| | | | | |
|---|---|---|---|---|
| 5,336,468 | A * | 8/1994 | Tezuka | B01L 3/0275 422/524 |
| 5,895,631 | A | 4/1999 | Tajima | |
| 6,086,825 | A * | 7/2000 | Sundberg et al. | 422/507 |
| 7,629,124 | B2 | 12/2009 | Hasson et al. | |
| 7,794,664 | B2 | 9/2010 | Pelletier et al. | |
| 8,071,057 | B2 | 12/2011 | Tokita et al. | |
| 8,900,811 | B2 | 12/2014 | Sundberg et al. | |
| 2005/0277125 | A1* | 12/2005 | Benn et al. | 435/6 |
| 2006/0165559 | A1 | 7/2006 | Greenstein et al. | |
| 2006/0285430 | A1 | 12/2006 | Sato | |
| 2012/0052560 | A1* | 3/2012 | Knight et al. | 435/286.1 |

FOREIGN PATENT DOCUMENTS

| | | | |
|---|---|---|---|
| JP | H8-320274 | A | 12/1996 |
| JP | 2006-349638 | A | 12/2006 |
| JP | 2007-520695 | A | 7/2007 |
| JP | 2008-151772 | A | 7/2008 |
| JP | 2008-232816 | A | 10/2008 |
| JP | 2009-128037 | A | 6/2009 |
| JP | 2009-525759 | A | 7/2009 |
| JP | 2009-542210 | A | 12/2009 |
| JP | 2010-510488 | A | 4/2010 |
| WO | 2005/052781 | A2 | 6/2005 |
| WO | 2009/006447 | A2 | 1/2009 |
| WO | 2009/125067 | A1 | 10/2009 |
| WO | 2010/021654 | A1 | 2/2010 |

OTHER PUBLICATIONS

Gilson, Pipetman M single channel & multichannel user's guide, 3-1 edition, (No. 1G1L0006/2-1), 36 pages (Feb. 2015).

Japanese Society for Tuberculosis et al., "Bio Safety Manual relating to Tubercle Bacillus," First Edition, 29 pages (2005).

* cited by examiner

METHODS, DEVICES, AND SYSTEMS FOR FLUID MIXING AND CHIP INTERFACE

CROSS-REFERENCE TO RELATED APPLICATION

The present application claims the benefit of priority to U.S. Provisional Application Ser. No. 61/378,722, filed on Aug. 31, 2010, the entire disclosure of which is incorporated herein by reference.

BACKGROUND

Field of the Invention

The present invention relates to methods, devices, and systems for fluid mixing and providing fluid to microfluidic devices. More particularly, aspects of the present invention relate to methods, devices, and systems for mixing fluids and delivering them into a microfluidic interface chip, and creating fluid segments that move through a microfluidic chip with minimal mixing between segments.

Description of the Background

In the field of microfluidics, a miniaturized total analysis system (μ-TAS), such as a "lab-on-a-chip," is frequently used for chemical sensing. A μ-TAS integrates many of the steps performed in chemical analysis—steps such as sampling, pre-processing, and measurement—into a single miniaturized device, resulting in improved selectivity and detection limit(s) compared to conventional sensors. Structures for performing common analytical assays, including polymerase chain reaction (PCR), deoxyribonucleic nucleic acid (DNA) analyses, protein separations, immunoassays, and intra- and inter-cellular analysis, are reduced in size and fabricated in a centimeter-scale chip. The reduction in the size of the structures for performing such analytical processes has many advantages including more rapid analysis, less sample amount required for each analysis, and smaller overall instrumentation size.

One of the advantages of lab-on-a-chip systems is the potential for mixing of reagents to occur on the chip. However, since laminar flow is the dominant flow mode in microfluidic systems, it is difficult to fully mix fluids in continuous flow systems. Fully mixed fluids can be achieved by, for example, increasing the time for mixing by diffusion. This can be achieved by increasing the channel length, slowing the flow rate, etc. Structures that disrupt laminar flow can also be introduced in the channel. See, e.g., U.S. Patent Application Publication No. 2010/0067323 to Blom et al. In a continuous flow system, however, increasing the degree of mixing of laminated fluids within a fluid sample (i.e., a droplet, slug, or plug of analyte or blanking fluid) also causes increased mixing between fluids in the series of fluid segments moving through the channel. That is, approaches which increase the on-chip or in-channel intermixing of fluids within a sample will also tend to increase the intra-mixing of fluids between samples. Thus, the length of the segments of fluids moving through the chip must be large enough such that mixing at the interface or boundary between the segments does not affect the analytical result.

Another issue with current μ-TASs and other microfluidic devices is the connection between the macro-environment of the world outside the device and the micro-components of a device. This aspect of the device is often referred to as the macro-to-micro interface, interconnect, or world-to-chip interface. The difficulty results from the fact that samples and reagents are typically transferred in quantities of microliters (μL) to milliliters (mL) whereas microfluidic devices typically consume only nanoliters (nL) or picoliters (pL) of samples or reagents due to the size of reaction chambers and channels, which typically have dimensions on the order of micrometers.

One method for introducing fluids into a microfluidic system is to simply form a well on the microfluidic device that connects directly to the microfluidic channel and place liquid in the well using a macrofluidic pipetting device. See, e.g., U.S. Pat. No. 5,858,195 to Ramsey and U.S. Pat. No. 5,955,028 to Chow. One disadvantage of this method is that it does not easily allow for a series of different fluids to be introduced into the same channel. This can reduce the efficacy of high throughput or continuous flow devices.

Another method for introducing fluids into a microfluidic system includes the use of a capillary (known in the art as a "sipper") attached directly to the chip that can be used to draw liquids into the chip. See, e.g., U.S. Pat. No. 6,150,180 to Parce et al. This method allows for different liquids to be drawn into the same channel in serial fashion. A disadvantage of this method is that air can also be drawn into the sipper which blocks the flow of liquid. Furthermore, the length of the column of liquid in the sipper adds a hydrostatic pressure that must be overcome to draw liquid into the chip. Keeping the pressure balanced so that flow is produced without drawing air into the sipper complicates the device design.

Accordingly, there is a need for providing improved methods, devices, and systems for fluid mixing and providing fluid to microfluidic devices.

SUMMARY

In one aspect, the present invention provides methods, devices, and systems for ensuring that multiple components of a mixture are fully mixed in a continuous flow microfluidic system while ensuring that mixing between segments flowing through the chip is minimized. In certain non-limiting embodiments, the present invention includes mixing fluids in a droplet maintained at the tip of a pipette before the fluid is introduced to the microfluidic device.

In one aspect, the present invention provides a method for mixing at least two fluids in a micropipette. The method may comprise: (a) drawing a first volume of a first mixing fluid into the micropipette; (b) drawing a second volume of a second mixing fluid into the micropipette; (c) optionally drawing one or more volumes of one or more other mixing fluids into the micropipette, (d) expelling a droplet including at least the first and second mixing fluids from the micropipette; (e) drawing the droplet back into the micropipette; and (f) optionally repeating steps (d) and (e). A volume of the droplet may be greater than half the total volume of mixing fluid in the micropipette.

According to various embodiments, the volume of the droplet expelled in step (d) is at least approximately equal to the total volume of mixing fluid in the micropipette. Steps (d) and (e) may be repeated two or more times. Steps (d) and (e) may be repeated three times. Steps (d) and (e) may be repeated until the first and second mixing fluids are evenly mixed.

According to one embodiment, the method may comprise (g) delivering the first and second mixing fluids in an evenly mixed state to a microfluidic chip. The method may further comprise washing the pipette and repeating steps (a) through (f) with at least a third mixing fluid and a fourth mixing fluid.

According to one embodiment, step (c) may comprise drawing a third volume of a third mixing fluid into the micropipette. The expelled droplet may additionally include the third mixing fluid, and the volume of the expelled droplet may be at least greater than half the sum of the first, second and third volumes. The volume of the droplet expelled in step (d) may be at least approximately equal to the sum of the first, second and third volumes. One of the first, second and third mixing fluids may be a primer fluid, another of the first, second and third mixing fluids may be a reagent, and still another of the first, second and third mixing fluids may be a patient sample. The method may comprise delivering the first, second and third mixing fluids in an evenly mixed state to a microfluidic chip. The droplet expelled in step (c) may not separate from the micropipette before drawing the droplet into the micropipette. In another embodiment, step (c) may comprise drawing four or more volumes of four or more mixing fluids into the micropipette, wherein the expelled droplet includes the four or more mixing fluids, and the volume of the expelled droplet is at least greater than half the sum of the four or more volumes. In this embodiment, the volume of the droplet expelled in step (d) is at least approximately equal to the sum of the four or more volumes.

According to some embodiments, the total volume of mixing fluid in the micropipette may be about 0 to about 4.0 μL. The total volume of mixing fluid in the micropipette may be about 4.0 μL. The steps of the method of mixing at least two fluids in a micropipette may be performed by an automated system. The steps of the method of mixing at least two fluids in a micropipette may be performed by a robotic system.

Another aspect of the invention is a pipette tip that may comprise: an exterior surface, an interior cavity configured to accept a volume of liquid, a proximal end, and a distal end configured to attach to a pipettor. At the proximal end, the tip may have an inside diameter and an outside diameter, wherein the outside diameter is greater than the inside diameter. The ratio of the outside diameter to the inside diameter may provide sufficient surface area for a droplet comprising up to the entire volume of the liquid to suspend from the pipette tip intact.

According to various embodiments, the pipette tip may comprise a disk attached to the proximal end. The disk may provide additional surface area to the proximal end of the tip.

Another aspect of the invention is a method for delivering a reaction mixture to a microfluidic chip. The microfluidic chip may comprise a docking receptacle, an access tube and a reservoir. The method may comprise: engaging a pipette tip containing the reaction mixture and having a docking feature with a reservoir of the microfluidic chip via a docking receptacle of the microfluidic chip, producing a bead of the reaction mixture from a pipette tip; wherein the bead makes contact with the access tube of the microfluidic chip, pulling at least a portion of the reaction mixture in the bead into the access tube of the microfluidic chip; and removing the bead from contact with the access tube of the microfluidic chip leaving reaction mixture only inside the access tube and not in the reservoir of the microfluidic chip.

According to various embodiments, the pipette tip may comprise a docking feature and may contain the reaction mixture to be delivered, the microfluidic chip may comprise a docking receptacle, and the method may further comprise engaging the pipette tip with the reservoir of the microfluidic chip via the docking receptacle of the microfluidic chip. The method may further comprise removing the docking feature of the pipette tip from engagement with the reservoir of the microfluidic chip. Following removal of the docking feature of the pipette tip from engagement with the reservoir of the microfluidic chip, there may be no air bubble formation in the access tube. The docking feature of the pipette tip and the docking receptacle of the microfluidic chip may align the pipette tip with the access tube of the microfluidic chip.

In some embodiments, the access tube may have a diameter greater than or equal to 50 microns and less than or equal to 200 microns. The access tube may have a diameter of 100 microns. The step of removing the bead from contact with the access tube of the microfluidic chip leaving reaction mixture only inside the access tube and not in the reservoir of the microfluidic chip may comprise withdrawing into the pipette the bead of the reaction mixture that was not pulled into the access tube.

The above and other aspects and features of the present invention, as well as the structure and application of various embodiments of the present invention, are described below with reference to the accompanying drawings.

BRIEF DESCRIPTION OF THE DRAWINGS

The accompanying drawings, which are incorporated herein and form part of the specification, illustrate various embodiments of the present invention. In the drawings, like reference numbers indicate identical or functionally similar elements. Additionally, the left-most digit(s) of the reference number identifies the drawing in which the reference number first appears.

DETAILED DESCRIPTION OF THE PREFERRED EMBODIMENTS

Figure 1:
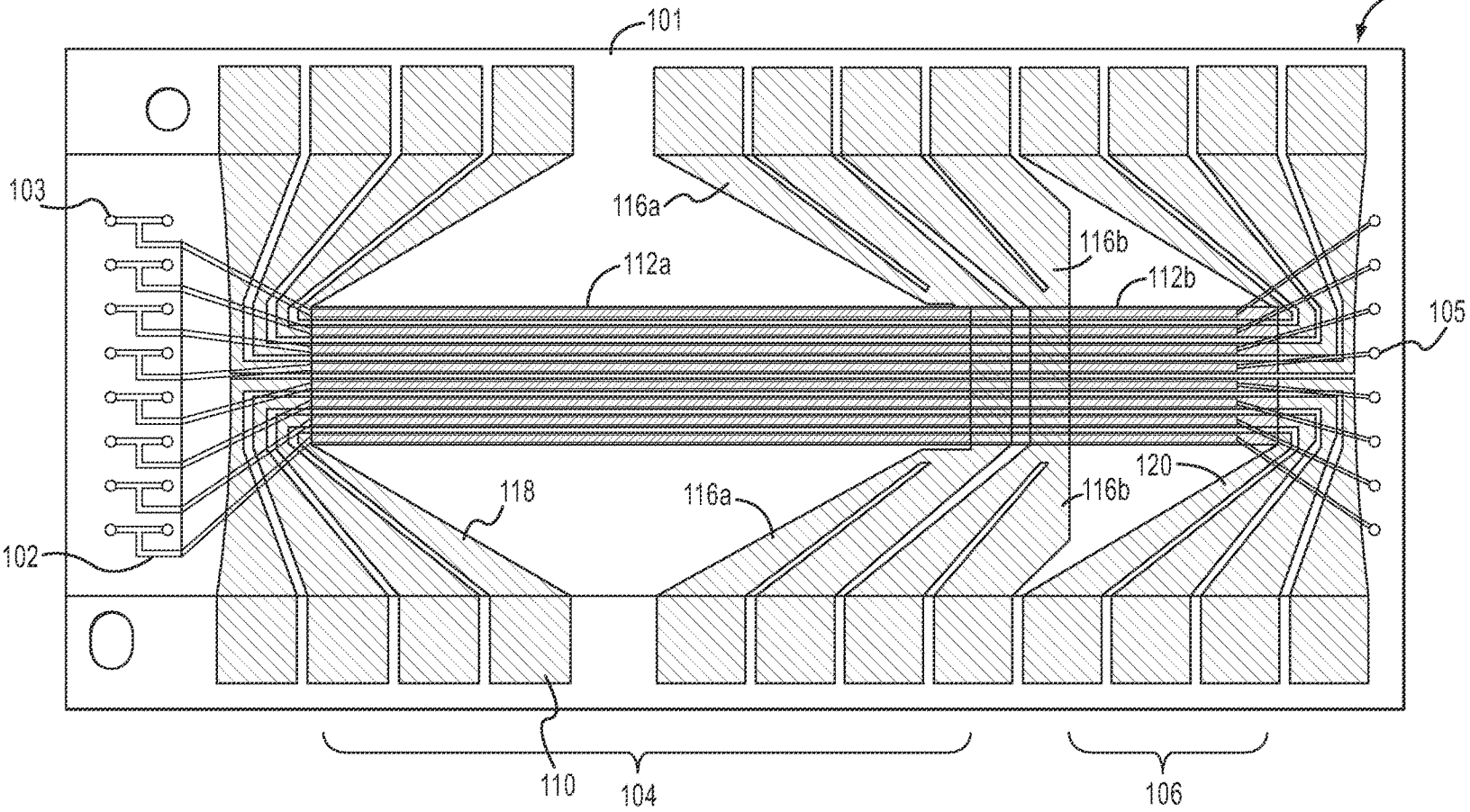
FIG. 1 illustrates a microfluidic device embodying aspects of the present invention.

FIG. 1 illustrates a microfluidic device 100 embodying aspects of the present invention. In some embodiments, the microfluidic device 100 may be a reaction chip. In the illustrated embodiment, the microfluidic device 100 includes several microfluidic channels 102 extending across a substrate 101. Each channel 102 includes one or more inlet ports 103 (the illustrated embodiment shows two inlet ports 103 per channel 102) and one or more outlet ports 105 (the illustrated embodiment shows one outlet port 105 per channel 102). In exemplary embodiments, each channel may be subdivided into a first portion extending through a PCR thermal zone 104 (as described below) and a second portion extending through a thermal melt zone 106 (as described below).

In an embodiment, the microfluidic device 100 further includes thermal control elements in the form of thin film resistive heaters 112 associated with the microfluidic channels 102. In one non-limiting embodiment, the thin film resistive heaters 112 may be platinum resistive heaters whose resistances are measured in order to control their respective temperatures. In the embodiment illustrated in FIG. 1, each heater element 112 comprises two heater sections: a PCR heater 112*a* section in the PCR zone 104, and a thermal melt heater section 112*b* in the thermal melt zone 106.

In one embodiment, the microfluidic device 100 includes a plurality of heater electrodes 110 connected to the various thin-film heaters 112*a* and 112*b*. In non-limiting embodiments, heater electrodes 110 may include PCR section leads 118, one or more PCR section common lead 116*a*, thermal melt section leads 120, and one or more thermal melt section common lead 116*b*. According to one embodiment of the present invention, a separate PCR section lead 118 is connected to each of the thin-film PCR heaters 112*a*, and a separate thermal melt section common lead 116*b* is connected to each of the thin-film thermal melt heaters 112*b*.

Figure 2:
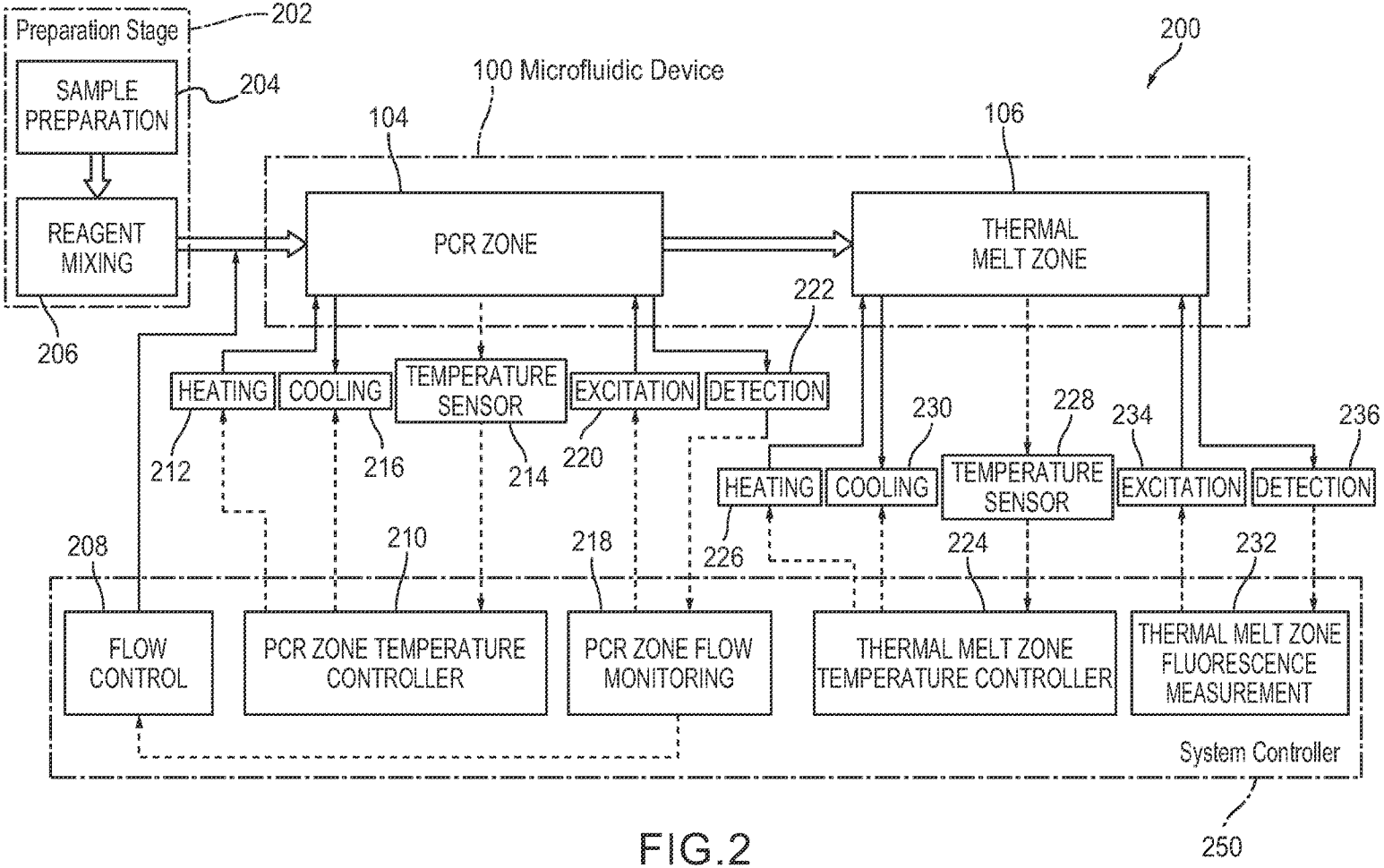
FIG. 2 is a functional block diagram of a system for using a microfluidic device embodying aspects of the present invention.

FIG. 2 illustrates a functional block diagram of a system 200 for using a microfluidic device 100, in accordance with one embodiment. The DNA sample is input in the microfluidic chip 100 from a preparation stage 202. As described herein, the preparation stage 202 may also be referred to interchangeably as the pipettor system. The preparation stage 202 may comprise appropriate devices for preparing the sample 204 and for adding one or more reagents 206 to the sample. Once the sample is input into the microfluidic chip 100, e.g., at an input port 103, the sample flows through a channel 102 into the PCR zone 104 where PCR takes place. That is, as explained in more detail below, as the sample flows within a channel 102 through the PCR zone 104, the sample is exposed to the PCR temperature cycle a plurality of times to effect PCR amplification. Next, the sample flows into the thermal melt zone 106 where a high resolution thermal melt process occurs. Flow of sample into the microfluidic chip 100 can be controlled by a flow controller 208. The flow controller may be part of a control system 250 of the system 200. The control system 250 may comprise the flow controller 208, a PCR zone temperature controller 210, a PCR zone flow monitor 218, a thermal melt zone temperature controller 224, and/or a thermal melt zone fluorescence measurement system 232. In some embodiments, the control system 250 may also comprise a thermal melt zone flow monitor and/or PCR zone fluorescence measurement system. Accordingly, in some embodiments, flow control in the thermal melt zone may occur via melt zone flow monitoring. Also, the flow controller 208 may comprise a single unit that simultaneously or alternately controls flow in both the PCR and thermal melt zones, or the flow controller 208 may comprise a PCR zone flow controller and a separate thermal melt zone flow controller that independently control flow in the PCR and thermal melt zones.

The temperature in the PCR zone 104 can be controlled by the PCR zone temperature controller 210. The PCR zone temperature controller 210, which may be a programmed computer or other microprocessor or analog temperature controller, sends signals to the heater device 212 (e.g., a PCR heater 112*a*) based on the temperature determined by a temperature sensor 214 (such as, for example, an RTD or thin-film thermistor, or a thin-film thermocouple thermometer). In this way, the temperature of the PCR zone 104 can be maintained at the desired level or cycled through a defined sequence. According to some embodiments of the present invention, the PCR zone 104 may also be cooled by a cooling device 216 (for example, to quickly bring the channel temperature from 95° C. down to 55° C.), which may also be controlled by the PCR zone temperature controller 210. In one embodiment, the cooling device 216 could be a peltier device, heat sink or forced convection air cooled device, for example.

The flow of sample through the microfluidic channels 102 can be measured by a PCR zone flow monitoring system 218. In one embodiment, the flow monitoring system can be a fluorescent dye imaging and tracking system illustrated in U.S. patent application Ser. No. 11/505,358, filed on Aug. 17, 2006, which is incorporated herein by reference in its entirety. According to one embodiment of the present invention, the channels in the PCR zone can be excited by an excitation device 220 and light fluoresced from the sample can be detected by a detection device 222. An example of one possible excitation device and detection device forming part of an imaging system is illustrated in U.S. Patent Application Publication No. 2008/0003593 and U.S. Pat. No. 7,629,124, which are incorporated herein by reference in their entirety.

The thermal melt zone temperature controller 224, e.g. a programmed computer or other microprocessor or analog temperature controller, can be used to control the temperature of the thermal melt zone 106. As with the PCR zone temperature controller 210, the thermal melt zone temperature controller 224 sends signals to the heating component 226 (e.g., a thermal melt heater 112*b*) based on the temperature measured by a temperature sensor 228 which can be, for example, an RTD, thin-film thermistor or thin-film thermocouple. Additionally, the thermal melt zone 106 may be independently cooled by cooling device 230. The fluorescent signature of the sample can be measured by the thermal melt zone fluorescence measurement system 232. The fluorescence measurement system 232 excites the sample with an excitation device 234, and the fluorescence of the sample can be detected by a detection device 236. An example of one possible fluorescence measurement system is illustrated in U.S. Patent Application Publication No. 2008/0003593 and U.S. Pat. No. 7,629,124, which are incorporated herein by reference in their entirety.

In accordance with aspects of the present invention, the thin film heaters 112 may function as both heaters and temperature detectors. Thus, in one embodiment of the present invention, the functionality of heating element 212 and 226 and temperature sensors 214 and 228 can be accomplished by the thin film heaters 112.

In one embodiment, the system 200 sends power to the thin-film heaters 112*a* and/or 112*b*, thereby causing them to heat up, based on a control signal sent by the PCR zone temperature controller 210 or the thermal melt zone temperature controller 224. The control signal can be, for example, a pulse width modulation (PWM) control signal. An advantage of using a PWM signal to control the heaters 212 is that with a PWM control signal, the same voltage potential across the heaters may be used for all of the various temperatures required. In another embodiment, the control signal could utilize amplitude modulation or alternating current. It may be advantageous to use a control signal that is amplitude modulated to control the heaters 212 because a continuous modest change in voltage, rather than large voltage steps, avoids slew rate limits and improves settling time. Further discussion of amplitude modulation can be found in U.S. Patent Application Publication No. 2011/0048547, which is incorporated herein by reference in its entirety. In another embodiment, the control signal could deliver a steady state power based on the desired temperature. In some embodiments, the desired temperature for the heaters is reached by changing the duty cycle of the control signal. For example, in one non-limiting embodiment, the duty cycle of the control signal for achieving 95° C. in a PCR heater might be about 50%, the duty cycle of the control signal for achieving 72° C. in a PCR heater might be about 25%, and the duty cycle of the control signal for achieving 55° C. in a PCR heater might be about 10%.

The microfluidic device 100 and the system 200 can be used in conjunction with aspects of the present invention. For example, one can obtain multiple reagents, mix them, deliver them to a microfluidic device (e.g., an interface chip), and utilize the flow controller 208 to create fluid segments that flow through the microfluidic device 100 with minimal mixing between the fluid segments, in accordance with aspects of the invention.

In non-limiting embodiments of the present invention, two or more mixing fluids can be mixed utilizing a micropipette, such as, for example, a positive air displacement micropipette. However, other types of micropipettes, such as, for example, a pressure driven micropipette may also be used. Also, a capillary may alternatively be used. Mixing can occur with the pipette tip itself and mixing fluids can be delivered in a mixed state, for example, to an access tube embedded in a microfluidic interface chip.

Figure 3B:
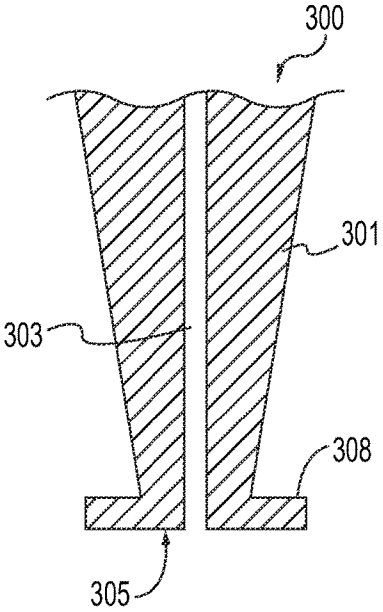
FIGS. 3A and 3B illustrate micropipette tips embodying aspects of the present invention.
Figure 3A:
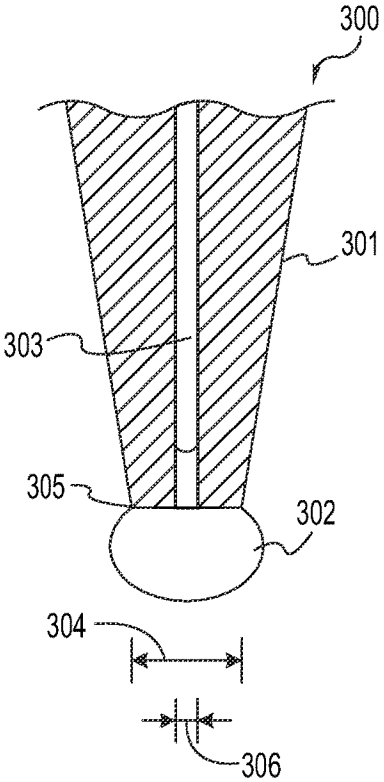

FIG. 3A illustrates a pipette tip 300 embodying aspects of the present invention. In some embodiments, the pipette tip 300 may have an exterior surface 301 and an interior cavity 303. The interior cavity may be 303 may be configured to accept a volume of a liquid. The pipette tip 300 may have an inside diameter 306 and an outside diameter 304. The outside diameter 304 may be greater than the inside diameter 306. The pipette tip 300 may comprise a proximal end 305 and a distal end. The distal end may be configured to attach to a pipettor. See, e.g., distal end 407 of FIG. 4. The pipette tip 300 may be constructed such that the mixing fluid remains a bead 302 on the end of the tip and does not move up the sides of the pipette tip. In some preferred embodiments, the ratio of the outside diameter 304 of the pipette tip to inside diameter 306 of the pipette tip may be sufficiently large at the orifice of the pipette tip such that inside diameter 306 is small enough to accurately collect less than 1 μL of fluid, while the outside diameter 304 is large enough to prevent liquid from wicking up the outside of the pipette tip when a bead 302 is formed outside the tip. Furthermore, in preferred embodiments, the ratio of the outside diameter 304 to the inside diameter 306 may provide sufficient surface area for a fluid bead 302 to attach by surface tension or other adhesion means. In other words, in some embodiments, the ratio of the outside diameter 304 to the inside diameter 306 may provides sufficient surface area for a droplet comprising up to the entire volume of the liquid to suspend from the pipette tip intact. In some embodiments, as illustrated in FIG. 3B, the pipette tip 300 may comprise a disk 308 attached to the proximal end 305 of the pipette tip 300. In one embodiment, the pipette tip 300 can comprise a 10 μL tip with a disk 308 attached to the proximal end 305 of the pipette tip 300. In one preferred embodiment, the disk has a 2.2 mm diameter and is 0.4 mm thick. The disk 308 may provide additional surface area to the proximal end 305 of the tip 300. The additional surface area may be sufficient for a fluid bead (e.g., fluid bead 302) to attach, while preventing the bead from climbing up the outside of the pipette tip 300.

Figure 4:
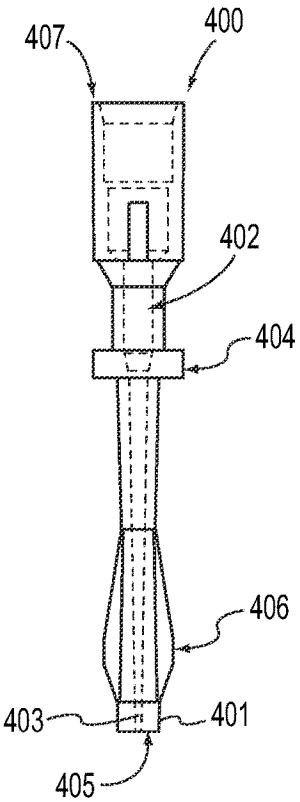
FIG. 4 illustrates a micropipette tip embodying aspects of the present invention.

FIG. 4 illustrates a pipette tip 400 embodying aspects of the present invention. In some embodiments, the pipette tip 400 may have an exterior surface 401 and an interior cavity 403. The interior cavity may be 403 may be configured to accept a volume of a liquid. Like pipette 300, pipette tip 400 may have an inside diameter and an outside diameter, and the outside diameter may be greater than the inside diameter. The pipette tip 400 may comprise a proximal end 405 and a distal end 407. The distal end 407 may be configured to attach to a pipettor. In some embodiments, the proximal end 405 may be configured as shown in FIG. 3A or FIG. 3B. As illustrated in FIG. 4, in some embodiments the pipette tip 400 includes a filter receiver 402 for storing a filter (not shown). In some embodiments, a filter can be located in the filter receiver 402 to minimize contamination beyond the pipette tip (that is, to prevent fluids in the disposable pipette tip from contaminating the pipette assembly 600).

In some embodiments, the pipette tip 400 also includes a load and eject interface 404. The interface 404 can be used to facilitate the automatic loading and removal of pipette tips, for example using a robotic control system.

Figure 5B:
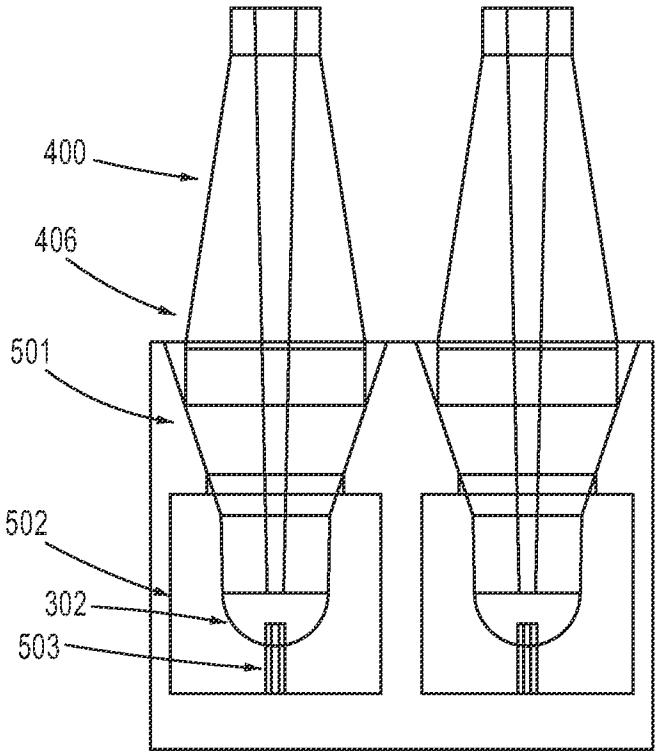
FIGS. 5A and 5B illustrate micropipettes and microfluidic devices embodying aspects of the present invention.
Figure 5A:
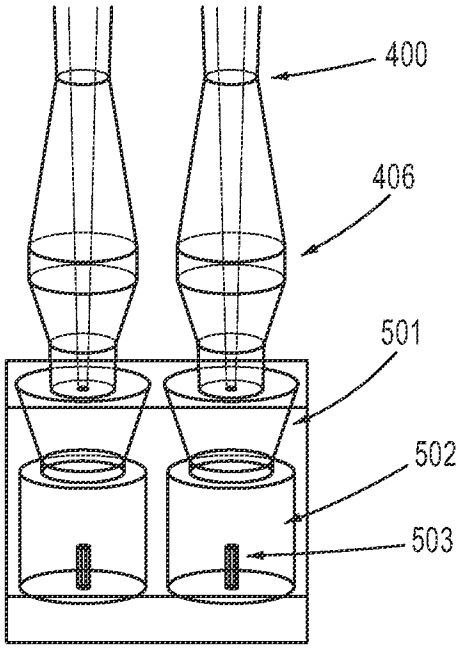

In some embodiments, the pipette tip 400 also includes a docking feature 406. The docking feature 406 can be used to enable automatic alignment of multiple tips with multiple access tubes (e.g., capillary tubes or other tubes), for example, by aligning each pipette tip with an access tube when the pipette tip is moved toward that access tube (e.g., when delivering fluids to an access tube of a microfluidic device). An example of the docking feature 406 is depicted in FIGS. 5A and 5B. FIG. 5A depicts pipette tip 400 having a docking feature 406 positioned above a reservoir or well 502 of a microfluidic chip having a docking receptacle 501 and an access tube 503. FIG. 5A depicts pipette tip 400 engaged with the reservoir or well 502 via the docking feature 406 and docking receptacle 501. Once engaged with the docking receptacle 501, the proximity of the pipette tip 400 and the access tube 503 allows the fluid bead 302 to contact the access tube 503 while remaining attached to the pipette tip 400. In some embodiments, the access tube 503 may have a diameter greater than or equal to 50 microns and less than or equal to 200 microns. In a non-limiting embodiment, the access tube 503 may have a diameter of 100 microns. However, other embodiments may alternatively use a different diameter including a diameter less than 50 microns or greater than 200 microns.

In one embodiment, mixing of the fluids can be accomplished by pushing the majority (i.e., more than half) of the fluid out of the pipette, to form a bead at the pipette tip, and retracting the bead back into the pipette tip. In some embodiments, this is repeated multiple times, such as, for example, four times. Surface tension prevents the bead from falling off of the pipette tip. As this bead is pushed forward and then retracted multiple times, the fluids swirl together and mix. In some embodiments, a small amount of fluid is used (for example, less than 10 μL) to ensure that the bead of liquid does not separate from the pipette tip.

Figure 6:
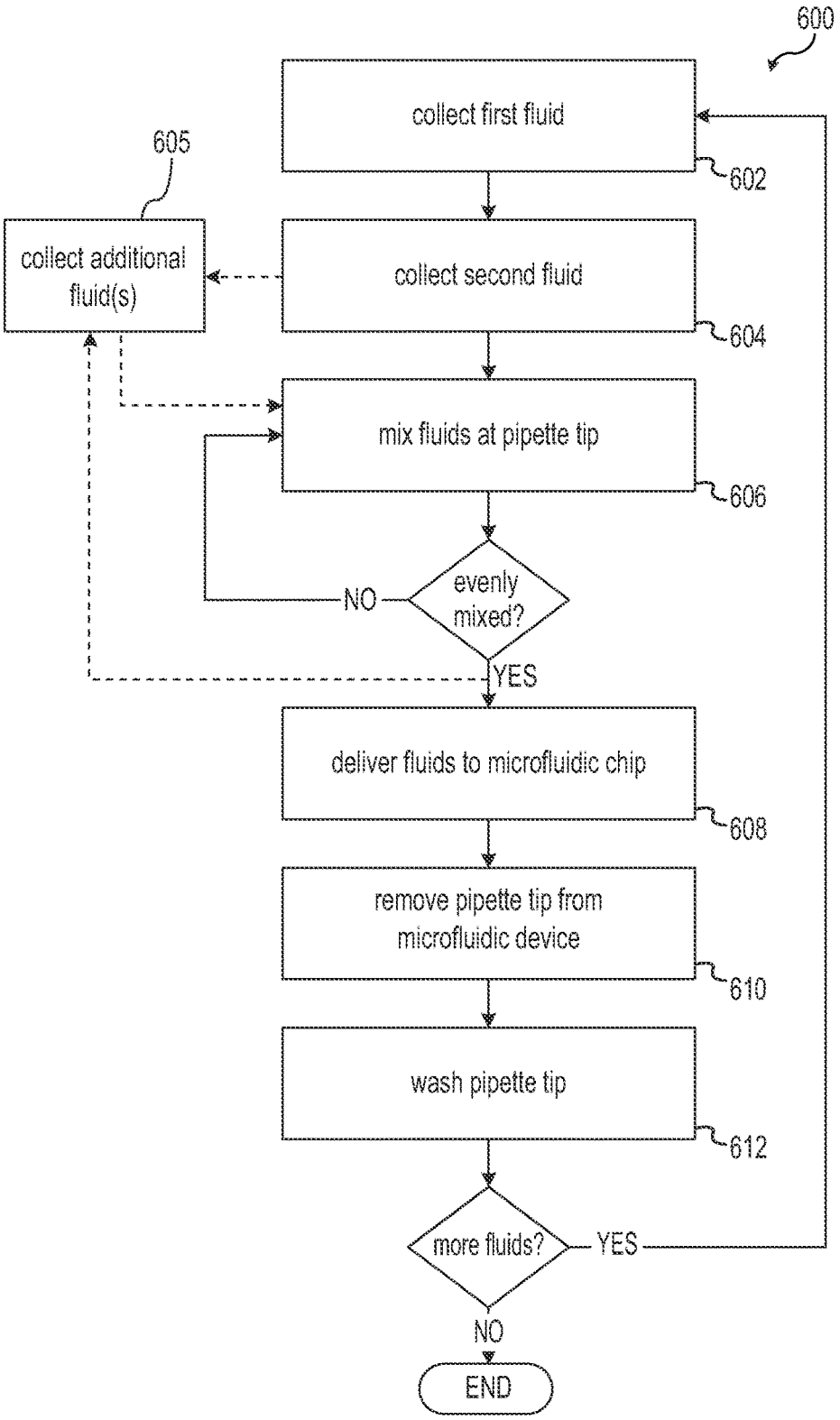
FIG. 6 illustrates a process for mixing two or more mixing fluids according to aspects of the present invention.

FIG. 6 illustrates a process 600 for obtaining multiple mixing fluids (for example, reagent fluids), fully mixing them, and delivering them to a microfluidic chip. The process 600 may be performed, for example, under the control of one or more robots (i.e., an automated controller of micropipettes for collecting, mixing, and delivering samples). The robot may be, for example, a PCR robot (i.e., an automated controller of micropipettes for collecting, mixing, and delivering PCR samples). The robot may or may not operate in conjunction with flow controller 208.

The process 600 may begin at step 602 at which a pipette collects an amount of a first mixing fluid. The first mixing fluid may be, for example, a reagent fluid, but this is not required. The amount of the first mixing fluid may be, for example, 3 μL. However, other amounts (e.g., more or less than 3 μL) of the first mixing fluid may be collected by the pipette. As will be understood by those having skill in the art, this can include drawing the first mixing fluid up into the pipette tip from, for example, a multi-well plate.

At step 604, the same pipette collects an amount of a second mixing fluid. The second mixing fluid may be, for example, a primer fluid or a reagent fluid. The amount of the second mixing fluid may be, for example, 3 μL. However, other amounts (e.g., more or less than 3 μL) of the second mixing fluid may be collected by the pipette. As will be understood by those having skill in the art, this can include drawing the second mixing fluid up into the pipette tip from, for example, a multi-well plate. Additional mixing fluids may be aspirated.

At step 606, the mixing fluids are mixed within the pipette. As described above, step 606 can include expelling a droplet of the mixing fluids, that is, pushing the majority of the mixing fluids out of the pipette to form a bead (e.g., a bead of approximately 6 μL) at the pipette tip and then drawing the bead back into the pipette tip. In some embodiments, the expelled droplet has a volume approximately equal to the volume of the mixing fluids that were collected by the pipette. In one non-limiting example, if 3 μL of the first mixing fluid and 3 μL of the second mixing fluid were collected by the pipette, in step 606, the pipette may expel a droplet having a volume approximately equal to the 6 μL. In some embodiments, the mixing of fluids in step 606 may be performed only if needed.

In some embodiments, the step 606 can be repeated multiple times to ensure that the mixing fluids are evenly mixed. For example, in some embodiments the bead can be cycled out of and into the micropipette 2, 3 or 4 or more times. In one non-limiting embodiment, the number of cycles needed to ensure even mixing is determined through empirical testing, and the number of cycles is set in advance. However, the number of cycles does not have to be set in advance. Alternatively, the system 200 may monitor mixing through optical, conductive, acoustic, or other means, and the number of cycles, the speed of the cycle, timing of the cycles, etc., may be varied based on feedback relating to degree of mixing. As a further alternative, the system 200 may use a combination where a predetermined number of cycles are performed and then feedback is obtained to determine whether fully mixed.

At step 608, the mixing fluids are delivered in a mixed state to a microfluidic chip. In some embodiments, for each fluid mix (i.e., reaction mixture) that is introduced into the interface chip, the pipette produces a small bead of fluid (e.g., approximately 1-4 μL) and causes the bead to make contact with the top of an access tube (e.g., capillary tube or other tube) in the microfluidic chip. After this contact is made, the pressure in the chip can be lowered (e.g., via the flow controller 208) to pull fluid into one or more channels of the chip. The pipettor may dispense additional fluid (i.e., reaction mixture) into the bead as it is aspirated into the chip.

At step 610, the pipette tip is removed from the microfluidic chip. In some embodiments, this can include removing the bead from contact with the access tube. When the pipette tip is removed from the access tube, the residual fluid remaining in the bead (i.e., fluid in the bead that was not drawn into the access tube) remains with the pipette tip due to higher surface tension on the tip relative to the access tube, thus leaving fluid only inside the access tube. This allows for fluids to be switched into the chip without leaving residual fluid in the area of the access tube.

In some embodiments, the inside diameter of the access tube is made small enough that the negative pressure used to move liquids into the chip does not exceed the back pressure due to surface tension within the mouth of the access tube. In other words, in some embodiments, the access tube is sized such that an air bubble will not be aspirated when the bead is removed because the control system pressure is not low enough to overcome the surface tension effects at the distal end of the access tube. Thus, air cannot enter the access tube which would cause bubbles in the access tube that block flow. This feature can prevent air bubbles from entering the microfluidic chip via the access tube.

At step 612, the pipette tip is washed to remove any residue of the mixed fluids (i.e., reaction mixture). However, in some embodiments, the washing of the pipette tip in step 612 may be performed only if needed. After step 612, the process 600 may return to step 602 to begin obtaining new fluids for mixing and delivery to the micro fluidic device.

In other embodiments of the present invention, beads can be made of sizes smaller or larger than those bead sizes described above in connection with FIG. 6. In addition, although the mixing fluids are described as being drawn up from a multi-well plate, it is not necessary that both mixing fluids be drawn from the same multi-well plate. The mixing fluids may instead be drawn from different multi-well plates. Also, the mixing fluids may be drawn up into the pipette tip from other sources, such as, for example, a single-well plate, single tube, flowing or stationary fluid reservoir, jug or any suitable structure capable of holding a liquid.

The system and method illustrated above is described in a non-limiting manner utilizing two mixing fluids and one pipette. In other embodiments, the present invention can be configured to simultaneously mix three or more mixing fluids in one pipette. For example, process 600 may include a step 605 of collecting one or more additional mixing fluids after the pipette collects an amount of the second mixing fluid at step 604 and before the mixing fluids are mixed within the pipette at step 606. There may also be one or more intermediate mixing steps before all of the mixing fluids to be mixed in the pipette have been collected. For example, as shown in FIG. 6, in some embodiments, after mixing two or more mixing fluids in the pipette in step 606, process 600 may proceed to step 605, where one or more additional mixing fluids are collected. Accordingly, mixing can be done in any manner including, for example: (i) mixing two, three, four or more mixing fluids at once, and (ii) mixing some subset of mixing fluids first and then adding additional mixing fluids and remixing. Other manners of mixing fluids are of course possible and may be performed by embodiments of the present invention. In the case of PCR, the present invention may be configured in one embodiment to mix, for example, a master mix, a DNA sample and one or primers.

Figure 7A:
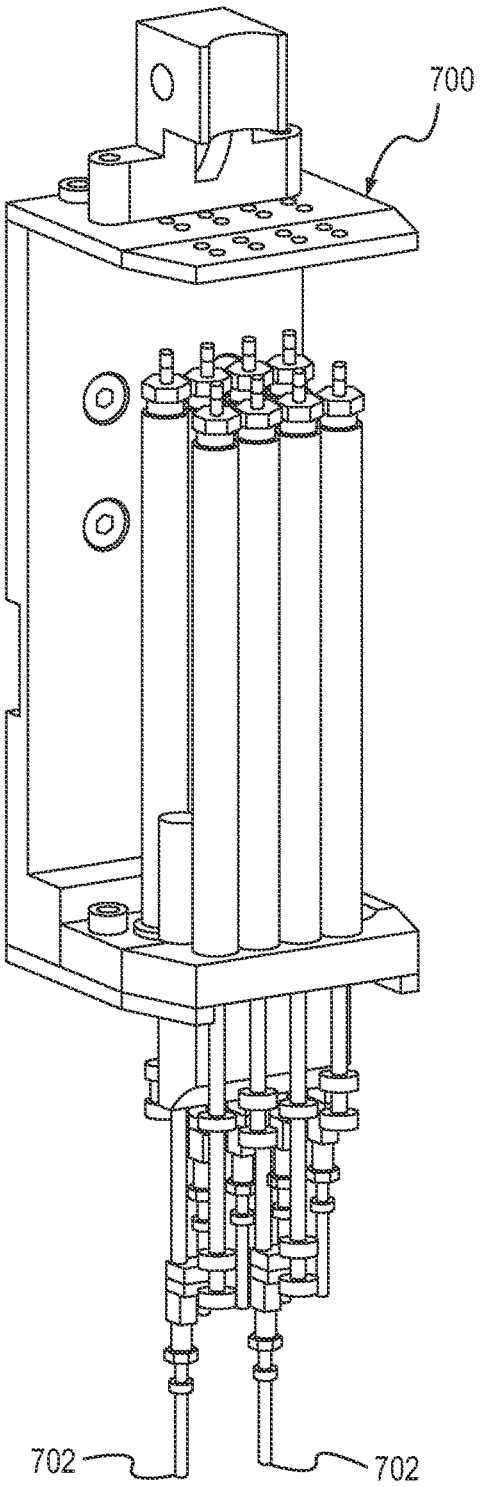
FIGS. 7A and 7B illustrate multichannel micropipette assemblies embodying aspects of the present invention.
Figure 7B:
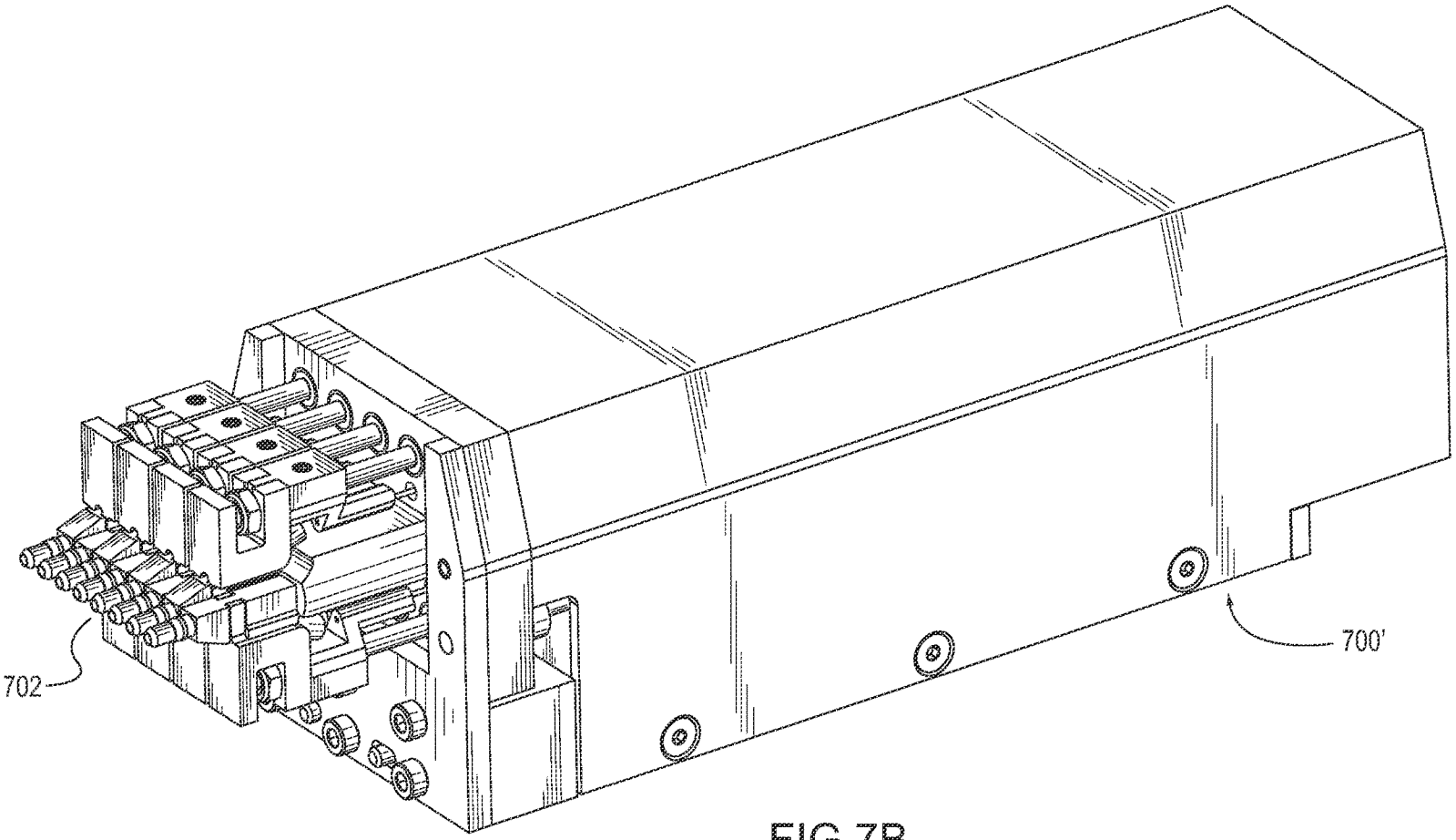

In further embodiments, the present invention can be configured to simultaneously mix three or more mixing fluids in a plurality of pipettes. For example, in one embodiment, FIG. 7A illustrates an eight-channel micropipette 700, that is, an assembly of eight micropipettes 702 that can be moved as a unit, for example, by robotic control (not illustrated) in an x, y, or z direction (or any combination thereof). In some preferred embodiments, the eight-channel micropipette 700 is configured such that each micropipette 702 can be individually extended (e.g., actuated in the z direction) for fluid delivery and/or retrieval. For example, in FIG. 7, two of the eight pipettes 702 are extended. This feature provides an embodiment wherein any specific reagent can be mixed with any of eight different patient samples. However, other multi-channel micropipettes may be used. For example, in one embodiment, the eight-channel micropipette 700' shown in FIG. 7B may alternatively be used. Further, it is not necessary that the micropipette have eight channels. Micropipettes having other numbers of channels may also be used.

Figure 8:
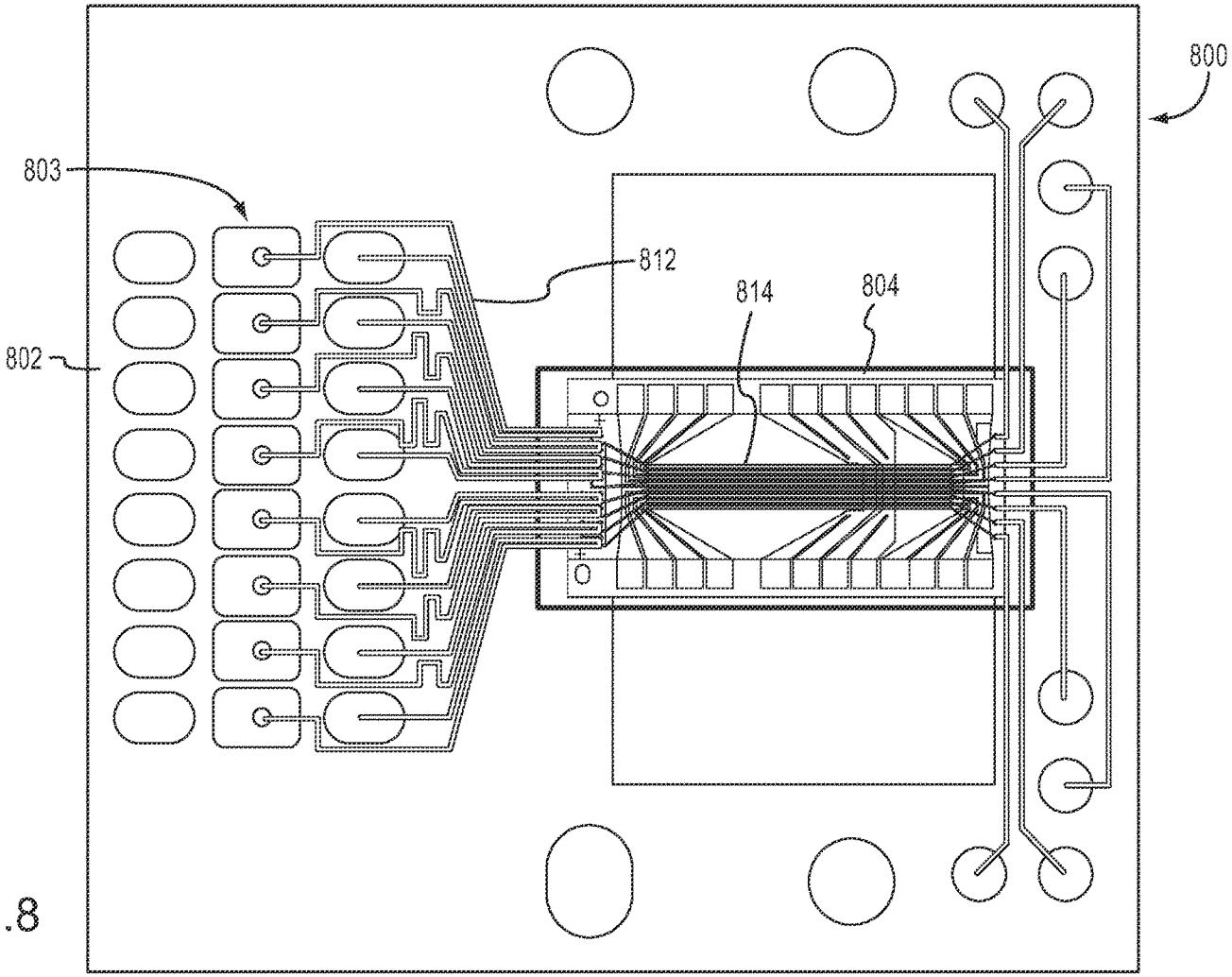
FIG. 8 illustrates a microfluidic system embodying aspects of the present invention.

FIG. 8 illustrates a microfluidic chip system 800 for providing fluid segments that move through a microfluidic chip with minimal mixing between serial segments, in accordance with some embodiments of the present invention. In the non-limiting exemplary embodiment of FIG. 8, the microfluidic chip system 800 includes an interface chip 802 and a reaction chip 804. In some embodiments, the interface chip 802 can contain access tubes (e.g., capillary tubes or other tubes) or wells 803 that allow different reaction mixtures (i.e., fluids) to be entered into the microfluidic system in series, such as by the process 600 described above. In some embodiments, the reaction chip 804 is a smaller chip that carries out the reaction chemistry, such as PCR and thermal melting. In some embodiments, the reaction chip 804 may be a microfluidic device such as the microfluidic device 100.

Figure 9:
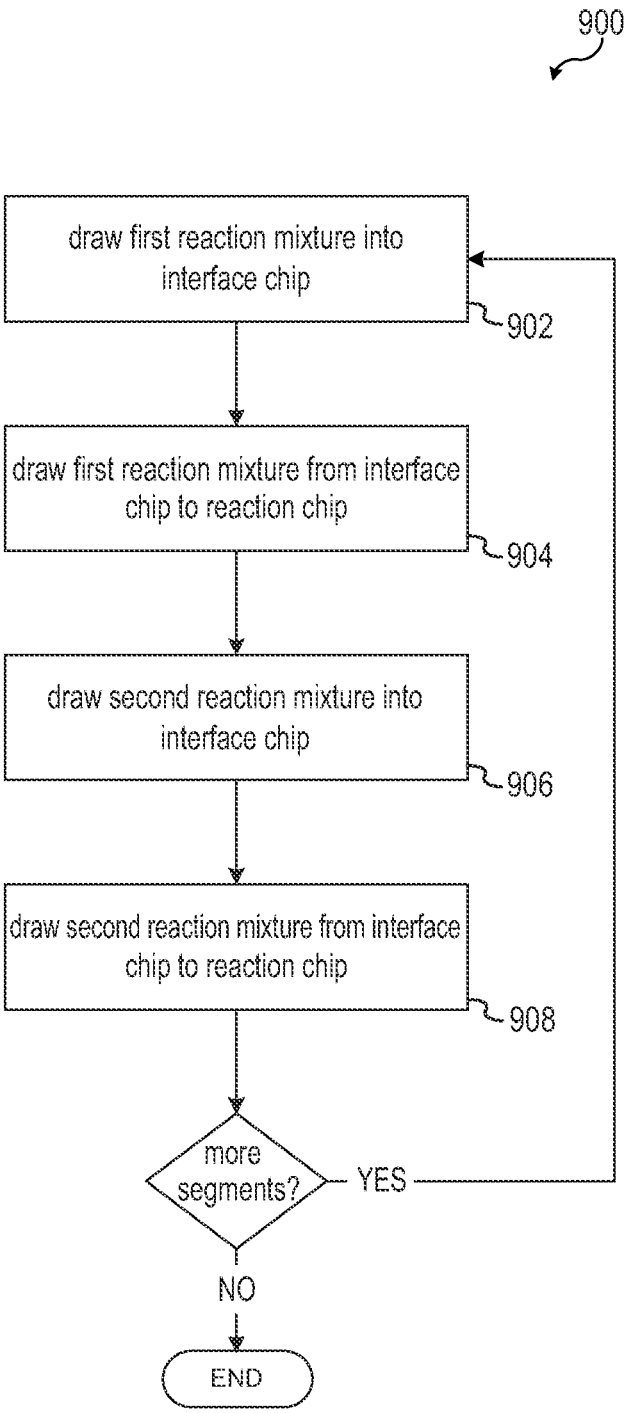
FIG. 9 illustrates a process for moving fluid segments through a microfluidic device according to aspects of the present invention.
Figure 10A:
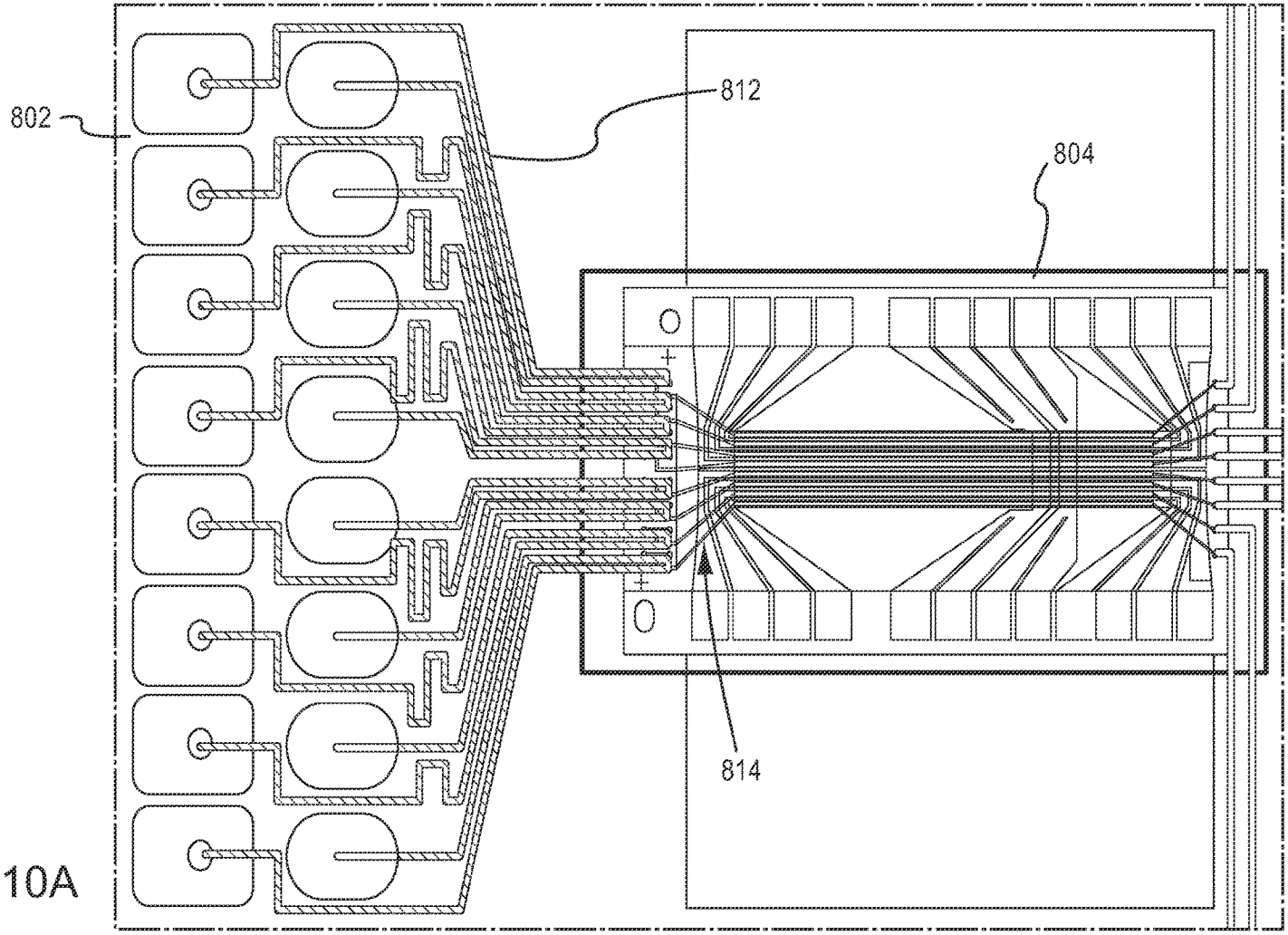
FIGS. 10A through 10E illustrate a fluid segments moving through a microfluidic device according to aspects of the present invention.
Figure 10B:
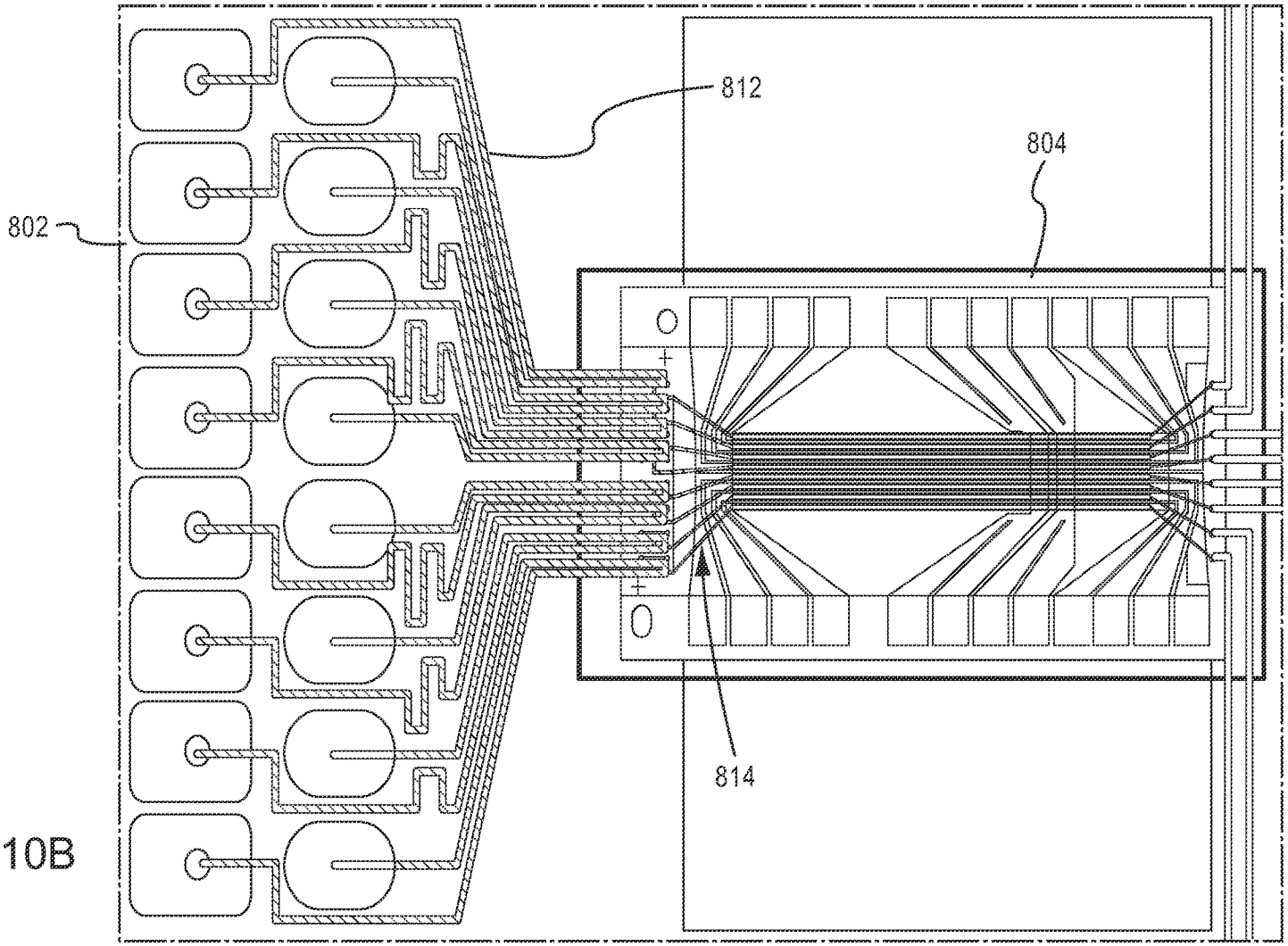

FIG. 9 illustrates a process 900 for moving fluid segments serially through a microfluidic chip (e.g., the microfluidic device 100 or reaction chip 804) in accordance with an embodiment of the present invention. The process 900 will be described below, with additional reference to FIGS. 10A through 10E, which illustrate the steps of the process 900 in relation to the interface chip 802 and the reaction chip 804. At step 902 (FIG. 10A), a first reaction mixture (represented by diagonal cross-hatching in FIGS. 10A through 10E) is drawn by a first pumping system into the microchannels 812 of the interface chip 802 to fill the microchannels 812. For example, in some embodiments the first reaction mixture may include a fluid mixed and provided to the interface chip 802 as described above with reference to the process 600, such as fluids for individual PCR reactions. In some embodiments, the step 902 may be performed by the flow controllers 208. Although FIG. 10A illustrates the same first reaction mixture being drawn into each of the microfluidic channels 812 of the interface chip, this is not required. The first reaction mixture drawn into any one of the microfluidic channels 812 may be different from the first reaction mixture drawn into any of the other microfluidic channels 812.

At step 904 (FIG. 10B), a second pumping system moves a segment of fluid from the microchannels 812 of the interface chip 802 into the microchannels 814 of the reaction chip 804. In some embodiments, the step 904 may be performed by the flow controller 208. In some embodiments, the same flow controller may control both the first and second pumping systems independently; in some embodiments, a separate flow controller 208 may control each pumping system.

Figure 10C:
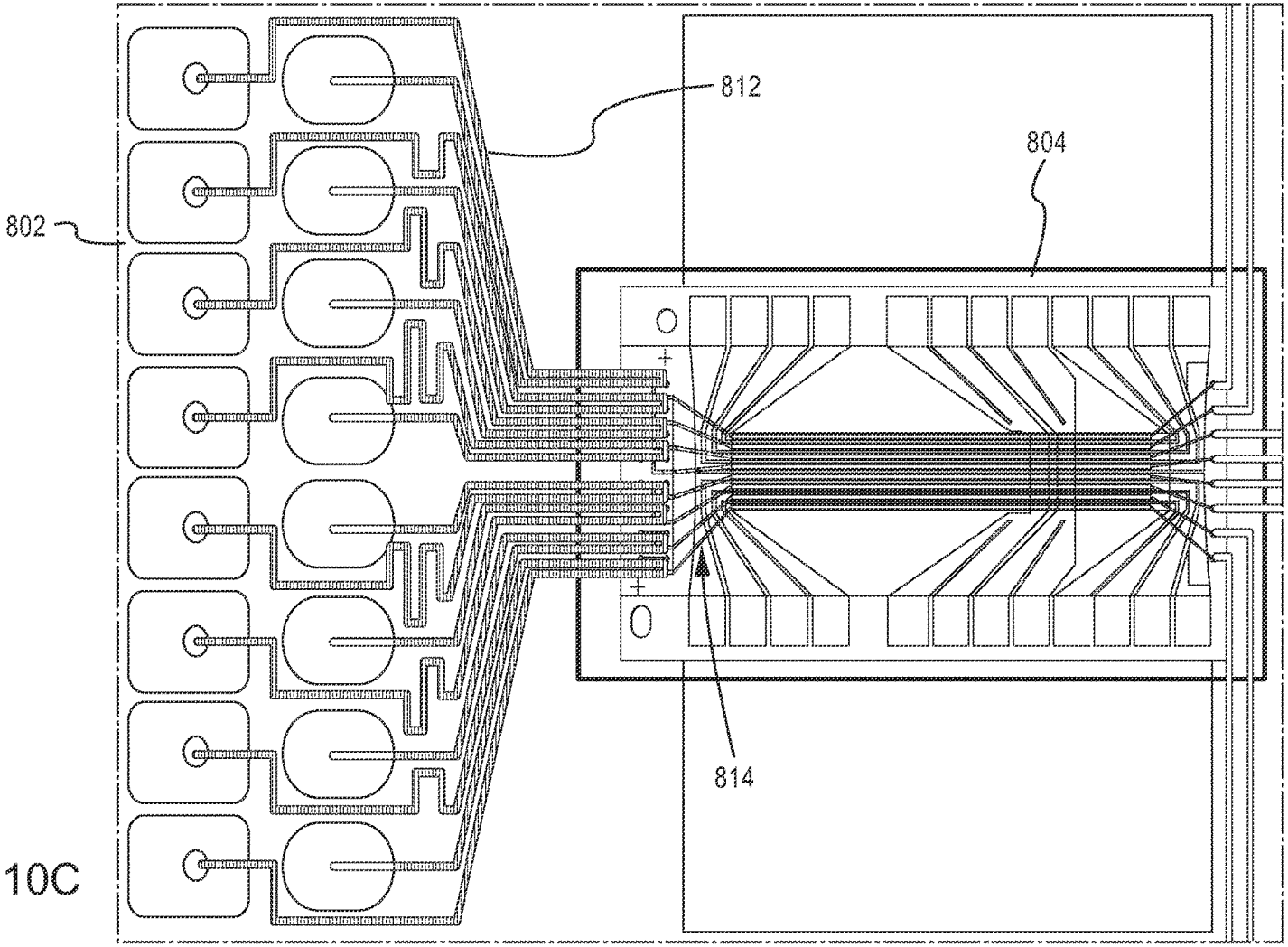

At step 906 (FIG. 10C), a second reaction mixture (represented by vertical cross-hatching in FIGS. 10A through 10E) is drawn by the first pumping system into the microchannels 812 of the interface chip 802 to fill the microchannels 812 with the second reaction mixture. For example, in some embodiments, the second reaction mixture may be a different mixture of fluids provided to the interface chip 802 as described above with reference to the process 600, such as spacer (i.e., blanking) fluid between the PCR reactions. In some preferred embodiments, drawing the second reaction mixture into the microfluidic channels 812 does not move the fluid segment of the first reaction mixture that is already in the microfluidic channels 814. In some embodiments, the step 902 may be performed by one or more flow controllers 208. Although FIG. 10C illustrates the same second reaction mixture being drawn into each of the microfluidic channels 812 of the interface chip, this is not required. The second reaction mixture drawn into any one of the microfluidic channels 812 may be different from the second reaction mixture drawn into any of the other microfluidic channels 812.

Figure 10D:
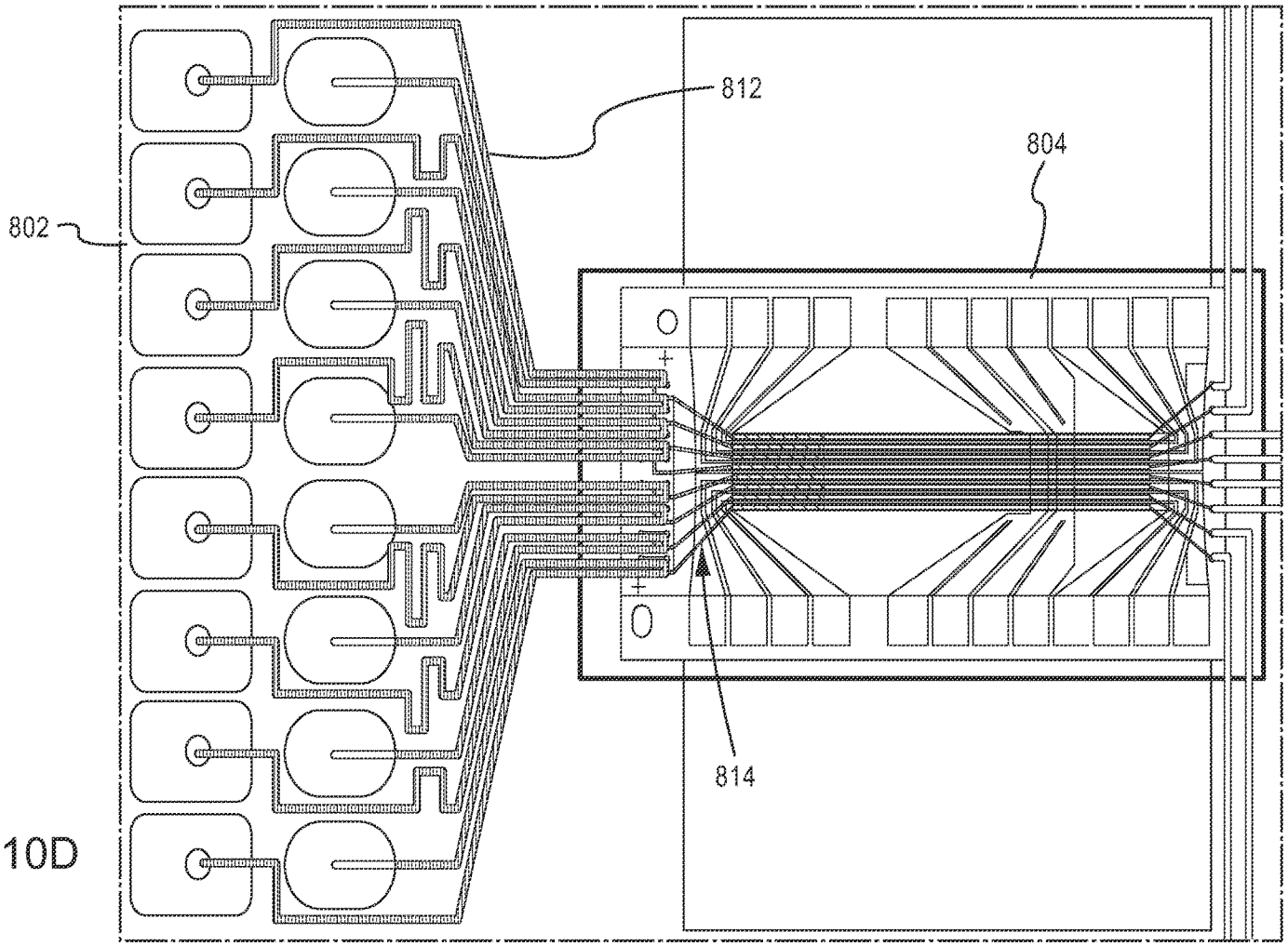

At step 908 (FIG. 10D), the second pumping system moves a fluid segment of second reaction mixture from the microchannels 812 of the interface chip 802 into the microchannels 814 of the reaction chip 804. As illustrated in FIG. 10D, the segments of second reaction mixture in the microchannels 814 of the reaction channel may be adjacent to the segments of first reaction mixture in the microchannels 814 of the reaction channel. In some embodiments, as the second reaction mixture is drawn into the microfluidic channels 814, the fluid segments of the first reaction mixture within the microfluidic channels 814 are drawn further into the microfluidic channels 814 of the reaction chip 804. In some embodiments, there are no air bubbles between the segments of the first reaction mixture and the segment of the second reaction mixture within the microfluidic channels 814. In some embodiments, the step 908 may be performed by the flow controller 208.

Figure 10E:
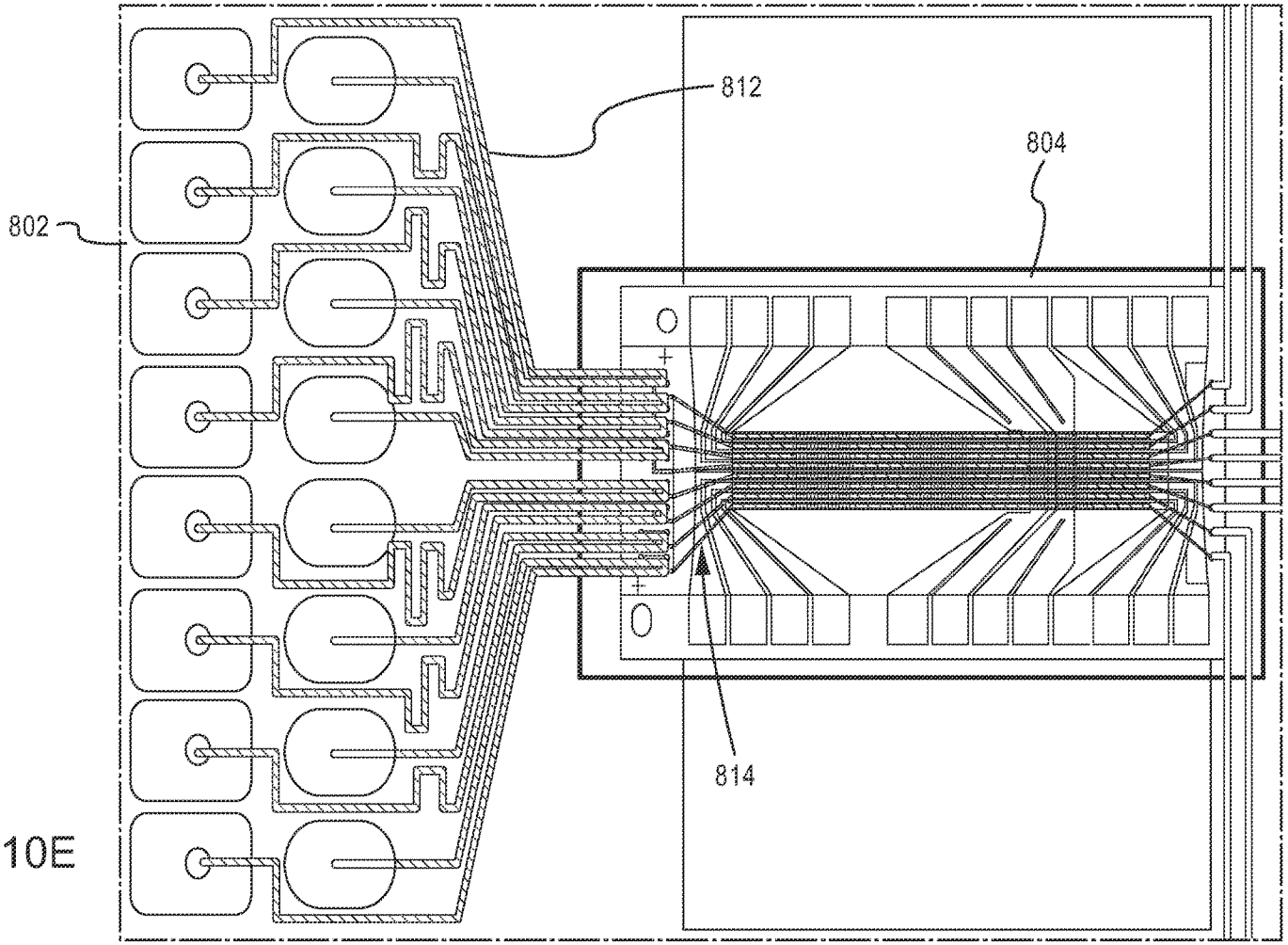

After a fluid segment of the second reaction mixture is provided to the microchannels 814 of the reaction chip 804, if more fluid segments are desired for the reaction chip 804, the process 900 can return to step 902 and provide another fluid segment of the first reaction mixture to the interface chip 802. In this way, process 900 may be used to create fluid segments alternating, for example, between the first and second reaction mixture (FIG. 10E).

The process 900 has been described above as creating fluid segments alternating between two reaction mixtures. As will be understood by those having skill in the art, in some embodiments, the above described methods can be readily adapted to creating segments of three or more different reaction mixture that flow serially through a microfluidic device (e.g., the reaction chip 804). For example, after the completion of step 908, the process 900 can return to step 902, but substitute a third reaction mixture for the first reaction mixture. In addition, a fourth reaction mixture may be substituted for the second reaction mixture, and so on.

Figure 11:
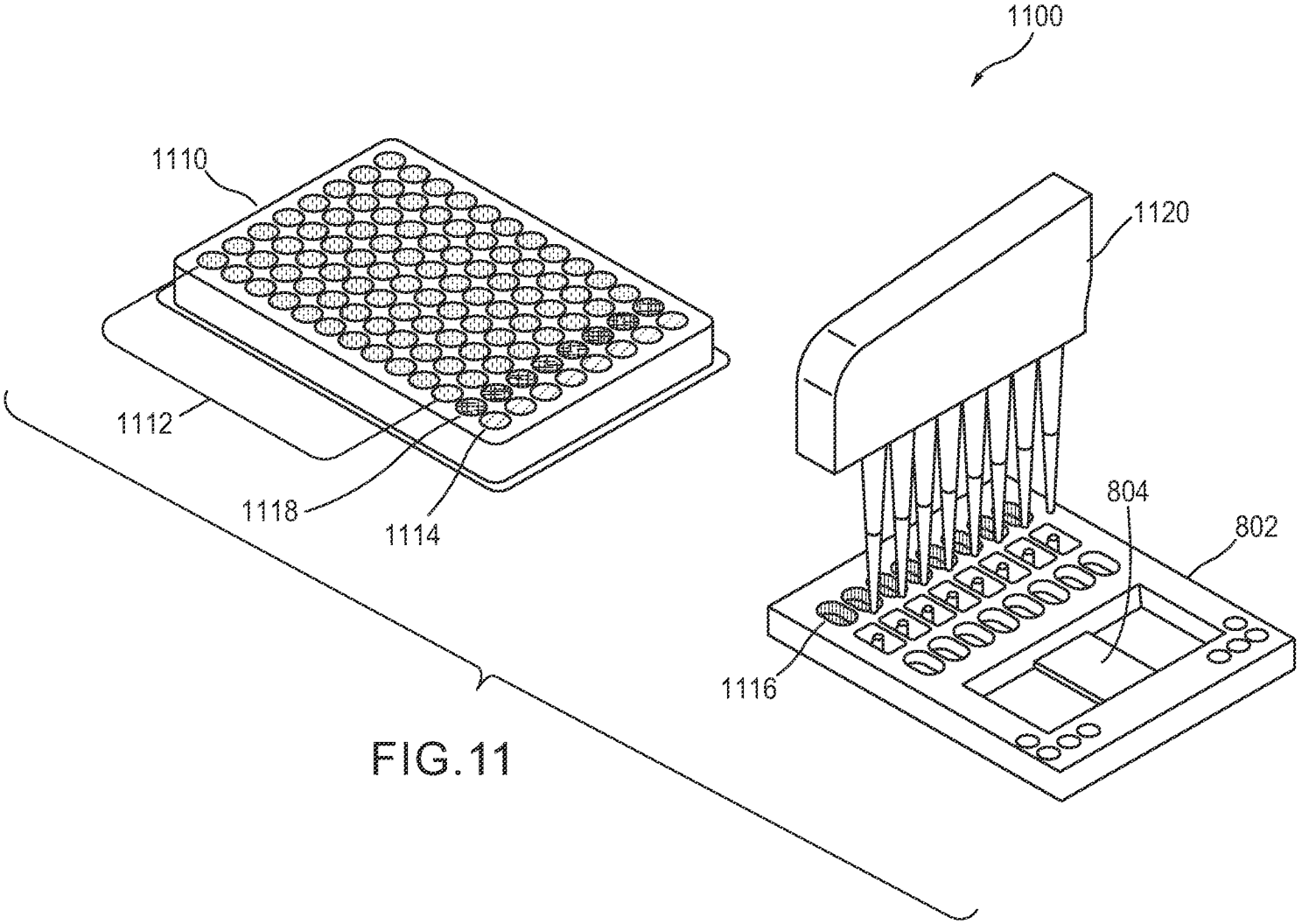
FIG. 11 illustrates a PCR system embodying aspects of the present invention.

Using the above methods for reagent selection, mixing and delivery to a chip, a completely random access microfluidic reaction device can be constructed, whereby patient samples can be assayed using any one of a panel of diagnostic test reagents. FIG. 11 illustrates an embodiment of a random access PCR system 1100 according to aspects of the present invention. In some embodiments, the system 1100 includes a sample tray 1110, one or more micropipettes 1120 (e.g., the eight-channel micropipette 700), an interface chip 802, and a reaction chip 804 (e.g., microfluidic device 100). In additional embodiments, the random access PCR system 1100 may include one or more additional features of the system 200, such as a flow controller 208, temperature controllers 210 and 224, and an optical system for recording fluorescence data (e.g., PCR zone flow monitor 218 and thermal melt zone fluorescence measurement unit 232).

Figure 12:
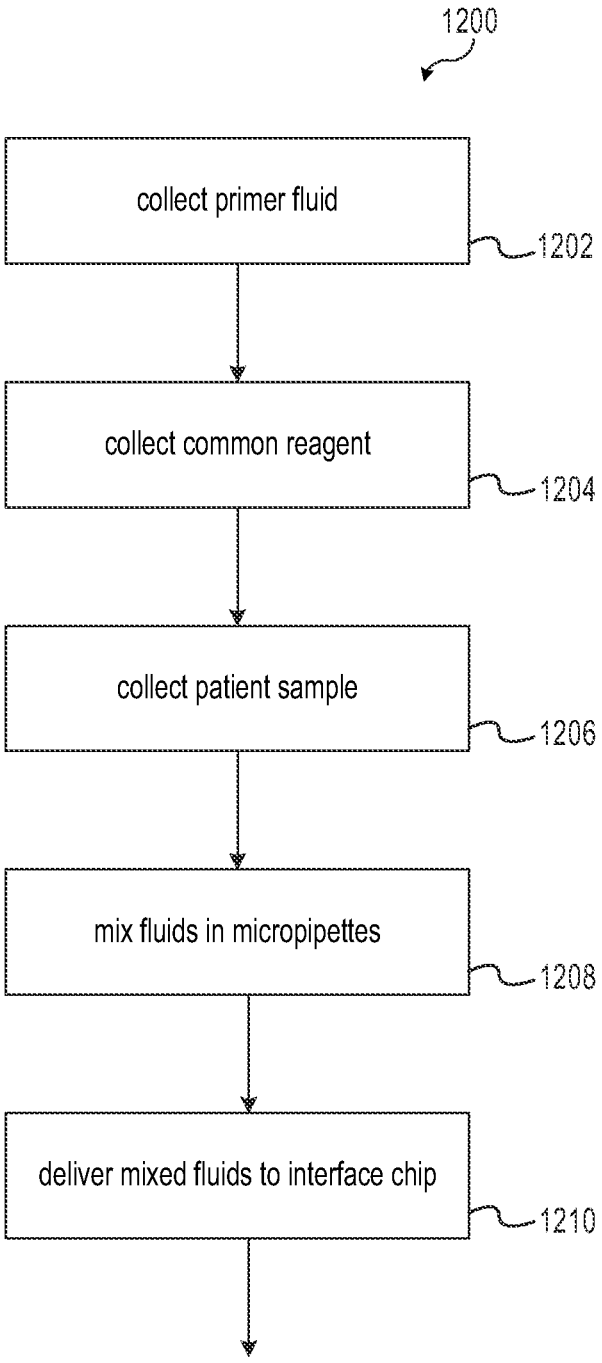
FIG. 12 illustrates an exemplary process for performing random access PCR according to aspects of the present invention.

FIG. 12 illustrates a process 1200 for performing a random access PCR assay, in accordance with one embodiment of the present invention. The process 1200 may begin at step 1202 at which one or more micropipettes 1120 collect a primer liquid 1112, for example, from the sample tray 1110. In some embodiments, each pipette tip can be independently actuated to collect a different primer liquid 1112.

At step 1204, each micropipette 1120 collects a reagent 1114.

At step 1206, each micropipette 1120 collects a patient sample 1116. For example, a patient sample 1116 can be stored in a well on the interface chip 802.

At step 1208, the each micropipette mixes the three mixing fluids therein. In some embodiments, this may be accomplished according to step 606 of the process 600, described above.

At step 1210, the mixed fluids are delivered to the interface chip 802. In some embodiments, this may be accomplished according to step 608 of the process 600, described above.

Figure 13:
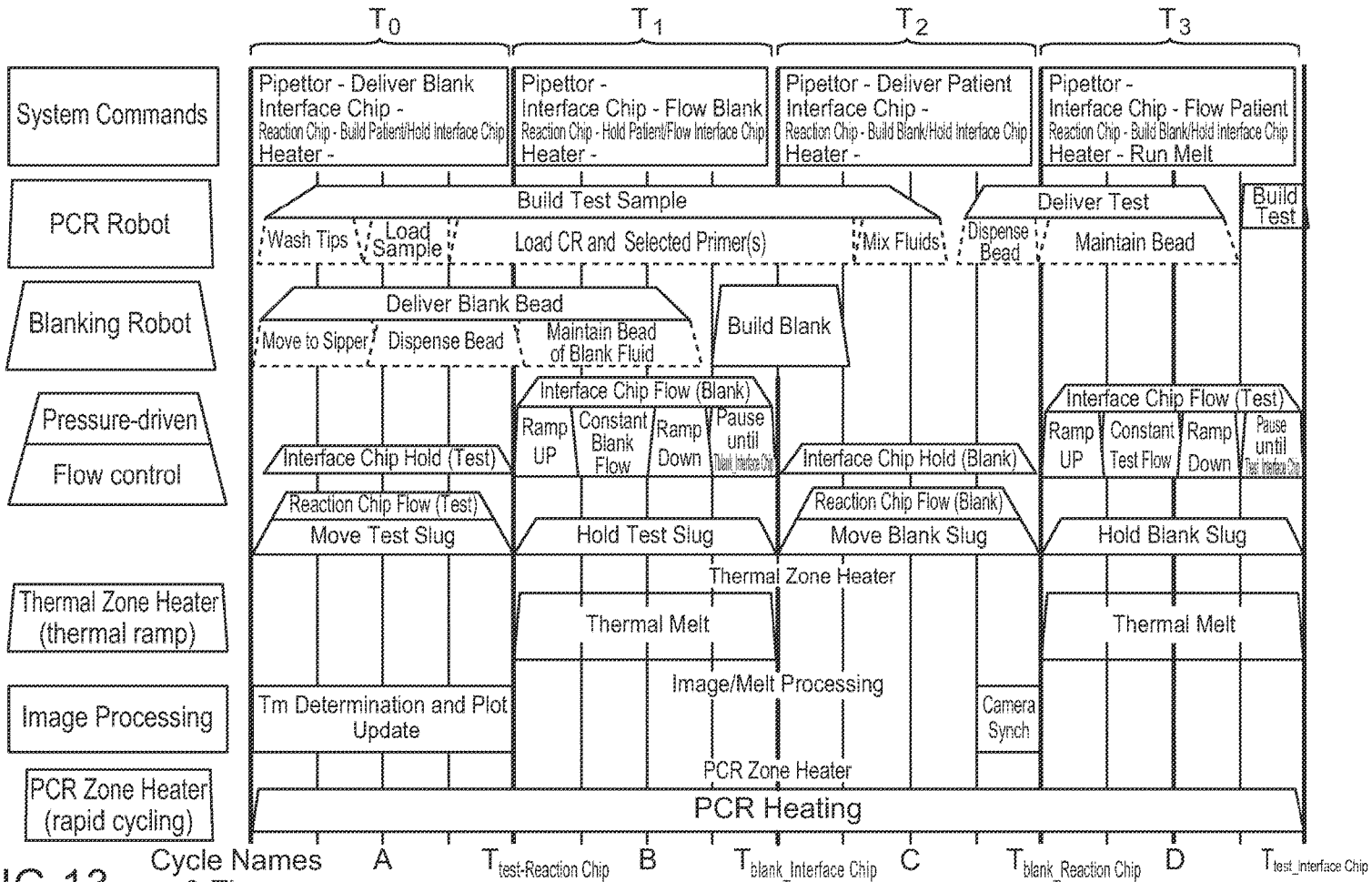
FIG. 13 illustrates a timing diagram for fluid delivery and movement through microfluidic devices according to aspects of the present invention.

FIG. 13 illustrates a timing diagram for a non-limiting example of fluid delivery and fluid movement through the two chips (e.g., the interface chip 802 and the reaction chip 804), in addition to the timing of heating and optical processing according to some embodiments of the present invention. The timing illustrated in FIG. 13 can be used to create a segmented flow in stop and go mode in the reaction chip (e.g., reaction chip 804) that allows for both PCR amplification and thermal melt analysis.

In one embodiment, at time $T_0$, a PCR robot (i.e., an automated controller of micropipettes for collecting, mixing, and delivering PCR samples) begins to build a test sample. In some embodiments, this includes washing the micropipette tips, loading a sample fluid 1116, loading a reagent 1114 and selected primers 1112, and mixing the loaded fluids. In a preferred embodiment, the loaded fluids may be mixed by process 600.

Also at $T_0$, a blanking robot (i.e., an automated controller of micropipettes for collecting, mixing, and delivering PCR samples) may begin to deliver a blank fluid segment that is already present in the micropipettes of the blanking robot. In some embodiments, this includes moving the micropipettes of the blanking robot to the access tubes of the interface chip 804, dispensing beads of blanking reaction mixture or fluids 1118 from the micropipettes and holding the beads of contact fluid in contact with the access tubes. In some embodiments, the blanking fluids may be water, buffer, gas, oil or non-aqueous liquid. The blanking fluids may or may not contain dye that enables the blanking solution to be tracked. In some embodiments, the blanking fluids may or may not have same solute concentration as non-blanking solution. In some embodiments, a test slug with dye therein is used for tracking, and the blanking fluids are only used for separation of droplets. The PCR and blanking robots together are referred to as "Pipettor" in FIG. 13. In one embodiment, two robots may be used for timing purposes. In other words, one robot may draw up fluids while the other is administering fluids to the interface chip. However, in some embodiments, one robot is used to provide both blanking fluid and PCR reagents. In embodiments using one robot, switching pipettes between fluids is not necessary.

Also at $T_0$, a flow controller 208 may move a sample segment from the interface chip 802 to the reaction chip 804.

At time $T_1$, the PCR robot may be continuing to build the next test sample.

By time $T_1$, the blanking beads from the blanking robot may be ready to be drawn into the access tubes of the interface chip 802 ("Interface Chip" in FIG. 13). Therefore, at time $T_1$, the blanking robot may maintain the beads of blanking fluid at the access tubes, and a flow controller (e.g., flow controller 208) may cause blanking fluid to flow through the access tubes and into the microfluidic channels 812 of the interface chip 802 while, in some embodiments, holding the sample fluid from moving in the microfluidic channels of the reaction chip 804 ("Reaction Chip" in FIG. 13). In some embodiments, the system may include a monitor to determine when the microfluidic channels of the interface chip are filled. In these embodiments, the blanking robot may receive a signal when the microfluidic channels 812 are filled with blanking fluid so that the blanking robot can perform other activities.

At time $T_2$, the PCR robot may complete building the test sample (i.e., completes mixing the fluids), and move to the access tubes of the interface chip 802 to deliver beads of the samples.

Also at time $T_2$, the blanking robot may build additional blanks (i.e., generates more blanking fluid). In some embodiments, this may be performed only as needed.

Also at time $T_2$, a flow control system may hold the blanking fluid in the microfluidic channels of the interface chip 802 while drawing the blanking fluid into the microfluidic channels 814 of the reaction chip 804 (creating a blanking segment in the reaction chip 804).

By time $T_3$, beads from the PCR robot may be ready to be drawn into the access tubes of the interface chip 802. Therefore, at time $T_3$, the PCR robot may maintain the sample beads at the access tubes, and a flow controller (e.g., flow controller 208) may cause the sample fluid (i.e., sample reaction mixture) to flow through the access tube and into the microfluidic channels 812 of the interface chip 802 while holding the blanking fluid from moving in the microfluidic channels of the reaction chip 804. In some embodiments, the system may include a monitor to determine when the microfluidic channels of the interface chip are filled. In these embodiments, the PCR robot may receive a signal when the microfluidic channels 812 are filled with sample fluid so that the PCR robot can perform other activities.

In some embodiments, the PCR zone temperature controller 210 may continue to perform rapid PCR heat cycling throughout the time period illustrated in FIG. 13. Additionally, in some embodiments, the thermal melt zone temperature controller 224 may perform a thermal melt ramp during one of the above time periods. That is, depending on the number of fluid segments in the reaction chip 804, in some embodiments, a sample fluid segment will be in a thermal melt zone of the reaction chip 804 (e.g., thermal melt zone 106 of the microfluidic device 100) during one or more of the time periods described above. Therefore, the thermal melt zone ramp may be provided by the thermal melt zone temperature controller during one of the time periods during which a sample fluid segment is within the thermal melt zone.

Figure 14:
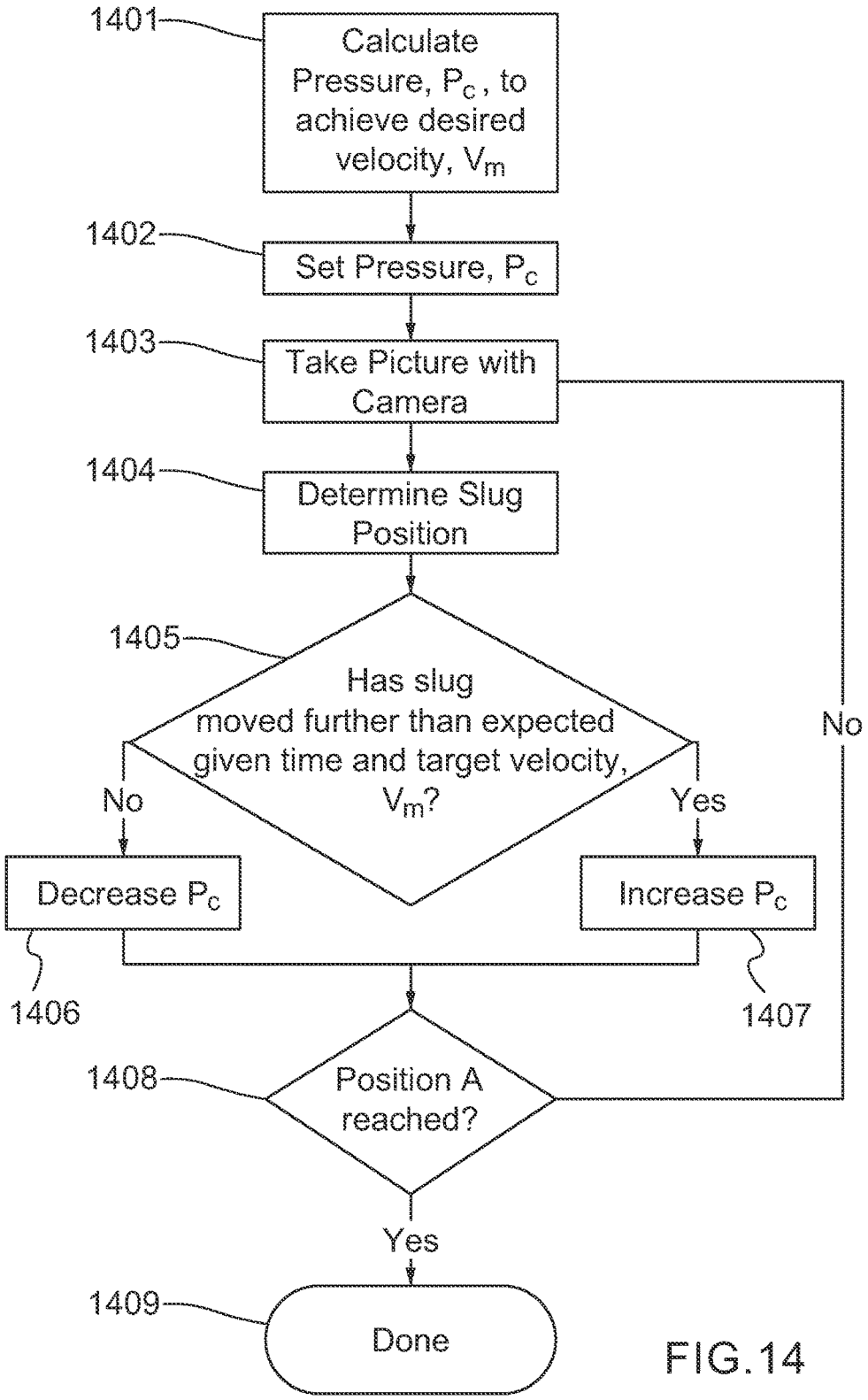
FIG. 14 illustrates a process for tracking and controlling the moving of fluid segments into a microfluidic device according to aspects of the present invention.

Furthermore, image processing may occur as necessary to obtain accurate position information of the fluid segments and accurate data for thermal melt analysis. In FIG. 14, a process is provided for utilizing image processing to track the location and movement of the fluid segments in accordance with one embodiment. In Step 1401, a flow controller (e.g., flow controller 208) may compute initial pressure Pc to force a slug to travel in the desired direction at velocity Vm. In step 1402, the flow controller 208 may drive pumps and monitor pressure sensors until the pressure sensors measure the desired pressure Pc. In step 1403, a picture trigger may be sent out and a camera 222 or 236 returns an image of the slug. In step 1404, the image may be analyzed to find slug features and to determine the location of the slug. In step 1405, the flow controller 208 may determine whether the slug position as a function of time (i.e., the target velocity) is too high or too low and will cause the process to move to step 1406 or 1407. If the target velocity is too high in comparison to a desired velocity, the flow controller 208 may move to step 1406. If the target velocity is too low in comparison to a desired velocity, the flow controller 208 may move to step 1407. In step 1406, the analysis of step 1405 determined that the slug was moving too fast in comparison to a desired velocity, and the flow controller 208 may then decrease the pressure setpoint Pc. In step 1407, the analysis of step 1405 determined that the slug was moving too slowly in comparison to a desired velocity, and the flow controller 208 then increases pressure setpoint Pc. In step 1408, system controller 250 may determine whether the slug is located in the desired position. If so, the movement process is complete, otherwise, the system controller 250 will continue the process with step 1403. The system controller may enter a different control mode at this point to maintain the slug in a desired position. Although some processes depicted in FIG. 14 have been described as being the function of the flow controller 208 or the system controller 250, it is envisioned that the actual controller that implements these steps may vary depending on variations in programming and system architecture, including as described below as to FIG. 15.

Also, in some embodiments, each time fluid segments are moved, the position of each fluid segment may be verified (e.g., via the PCR zone flow monitor 218). In one non-limiting embodiment, if any fluid segments are not within a specified percentage of their target locations, such as, for example 25%, the affected channel is disabled for further tests. Other percentages could also be used.

Figure 15:
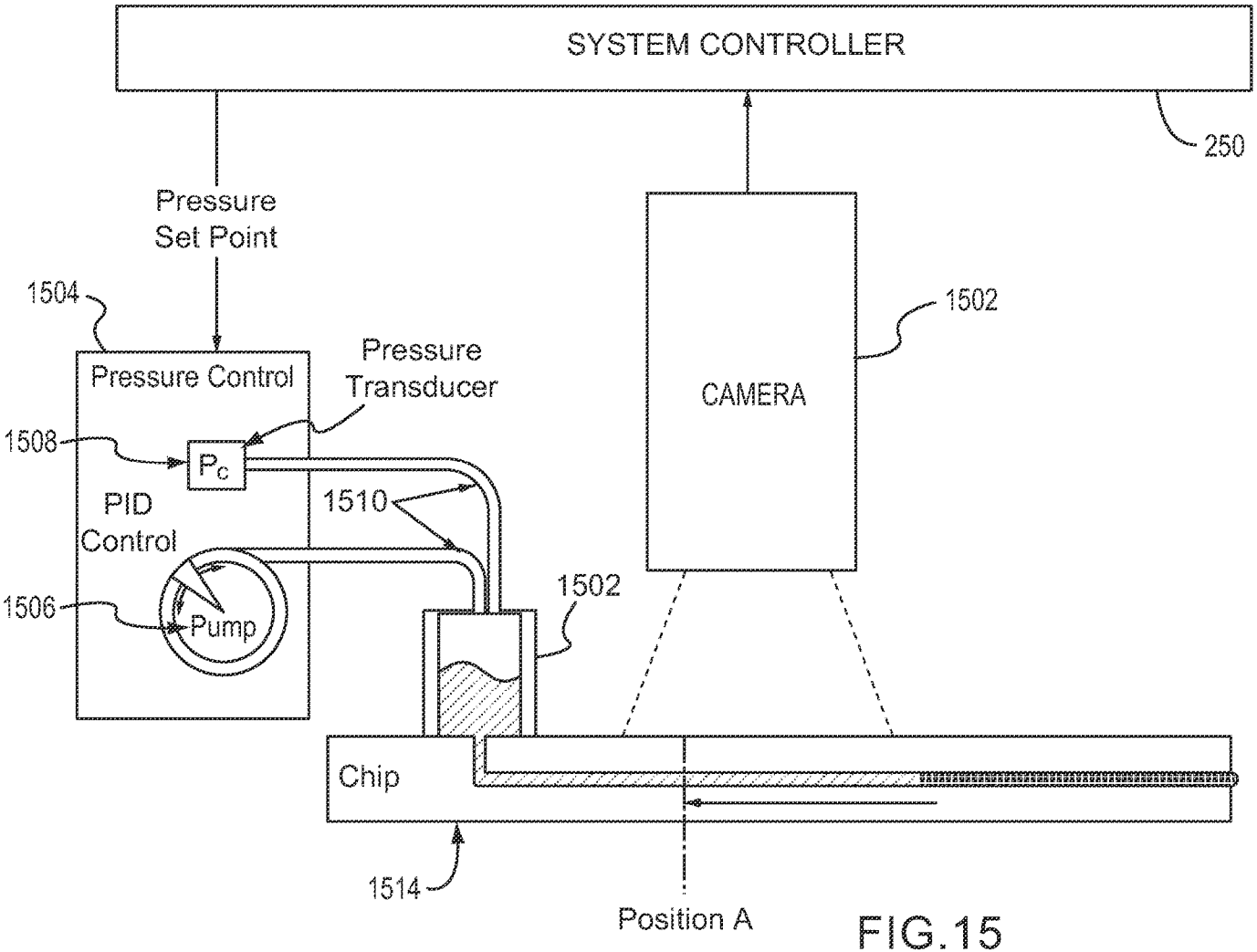
FIG. 15 illustrates components of a flow control system for controlling the moving of fluid in a device according to aspects of the present invention.

FIG. 15 is a block diagram of a flow control system that can be used in the process depicted in FIG. 14 or in other embodiments of the present invention. System controller 250 may interface with a camera 1502 (e.g., camera 222 or 236) to send an image trigger and to receive a picture in response. The system controller 250 may request pressure readings from a pressure controller 1504, which may be implemented using a printed circuit board (PCB), and will send the desired pressure setpoint values to one or more pumps 1506 of the pressure controller 1504. The pressure controller 1504 may run a local control loop to cause the one or more pumps 1506 to maintain the desired pressure sent by the system controller 250. The pressure controller 1504 may use a pressure transducer 1508 to detect pressure. Pump tubing 1510 may be connected to fluid wells or reservoirs 1512 (e.g., reservoirs or wells 502) on a microfluidic chip 1514 (e.g., microfluidic device 100 or reaction chip 804) to force liquids to flow in the desired direction.

Figure 16:
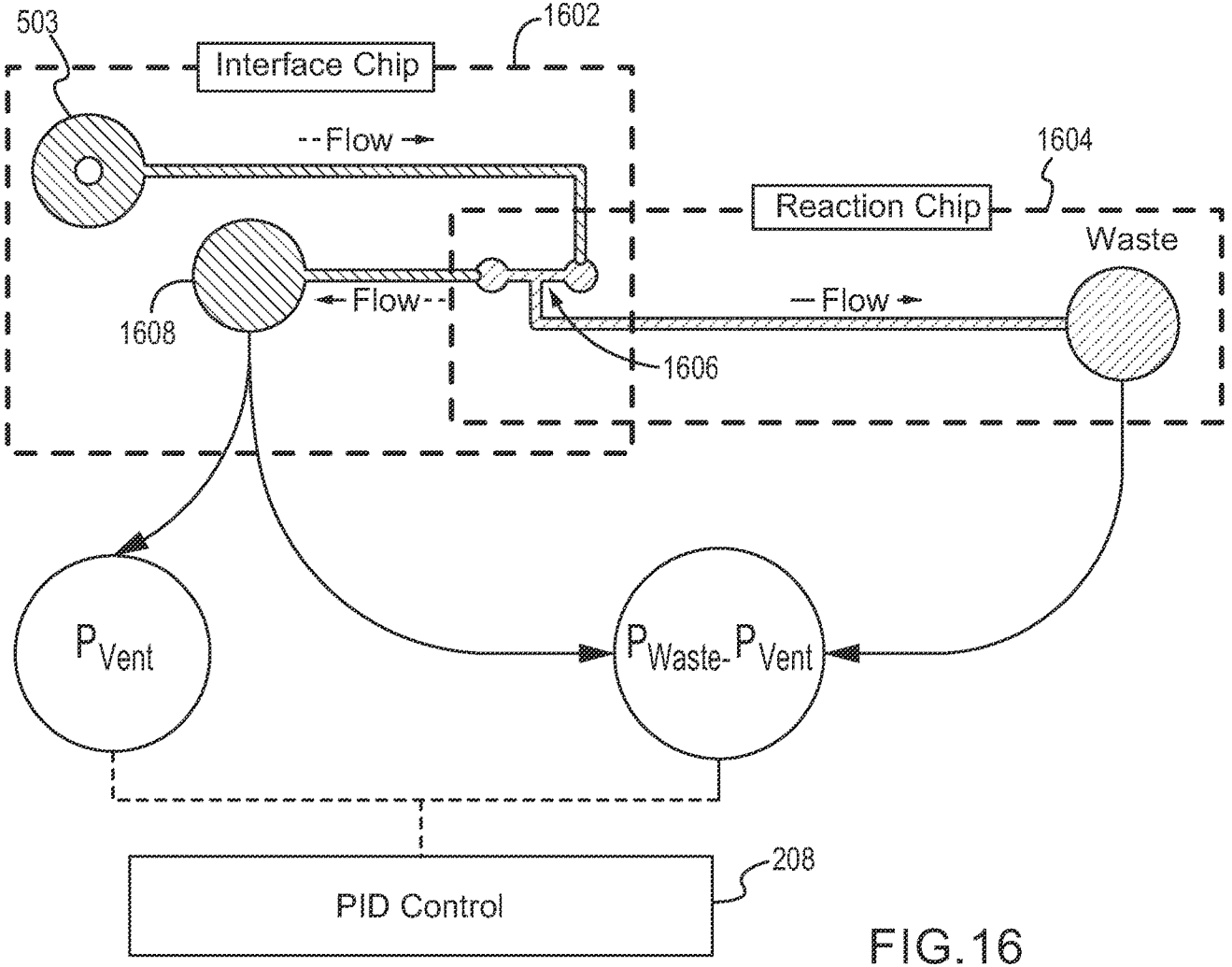
FIG. 16 illustrates a flow control system for moving fluid segments through a microfluidic device according to aspects of the present invention.

FIG. 16 provides an illustration of a mechanism for controlling the flow of fluid (i.e., reaction mixture) in a system according to an embodiment of the present invention. A capillary or sipper 503 is present in an interface chip 1602 (e.g., interface chip 802) at atmospheric pressure with a drop of fluid located at end. The drop may be applied via the methods and systems of the present invention, including those depicted in FIG. 5A and FIG. 5B and as described herein. The system controller 250 will set a negative pressure at a vent well to cause fluid to flow from capillary 503, through the interface chip 1602 onto the reaction chip 1604 (e.g., microfluidic device 100 or reaction chip 804) and through a "T" junction 1606 present in the reaction chip. Pressures may be controlled via a pump controlled by a flow controller (PID control) 208. The fluid will then flow back out of the reaction chip onto the interface chip and to the vent well 1608. When the "T" junction 1606 and surrounding area of the interface chip 1602 are loaded with fluid, the system controller 250 will stop the fluid flow in the interface chip 1602. The system controller 250 will then start the fluid flow in the reaction chip 1604 to move the slug to desired location. Once the slug has reached the desired location, the system controller 250 will cause the fluid flow to stop in the reaction chip 1604, and the system controller 250 can cause the pipetting system 202 to place a new drop of fluid on the capillary 503. The system controller 250 can then cause the process to begin and loop until all desired slugs have been created.

In one aspect of the present invention, the T-junction between an interface chip and a reaction chip can be utilized to create alternating slugs of multiple fluids (i.e., reaction mixtures) while decreasing the amount of diffusion between the slugs, as is described in U.S. Patent Application Publication No. 2011/0091877, which is incorporated by reference herein in its entirety. The present invention therefore may include a method of collecting, from a continuous flow of two or more miscible fluids sequentially present in a channel, one or more samples that are substantially free from contamination by the other miscible fluids present in the channel. In one embodiment, the method may comprise: a. identifying and monitoring the position of a diffusion region between uncontaminated portions of a first miscible fluid and a second miscible fluid in a first channel; b. diverting the diffusion region into a second channel; and c. collecting a portion of the second miscible fluid which is substantially free from contamination by any miscible fluids adjacent to the second miscible fluid.

Although FIGS. 15 and 16 illustrate examples of a flow control system and mechanism for controlling the flow of fluid, respectively, that may be used in embodiments of the present invention, use of the particular system and mechanism illustrated in FIGS. 15 and 16 is not required and other systems and mechanisms may be used.

Illustrative Example

Using a micropipette, reagent solution, and blanking solution, a set of mixing tests were performed in accordance with the above-described systems and processes. As will be understood by those having skill in the art, blanking solution and primer solution are similar in composition and, therefore, similar results would be expected when mixing reagent and primer solution. Blue dye (xylene cyanol) was added to the blanking solution to allow for easy visualization of mixing in the visible light spectrum. For each test, 3 μL of reagent and 3 μL of blanking solution were drawn up into a micropipette tip from a 384 well plate, and a photo was taken to indicate this initial state. The fluids were then pushed out of the pipette tip, forming a 6 μL, bead, and then retracted.

A photo was taken of this state. The bead was cycled 3 more times, with another picture being taken after each cycle. Four mixing cycles in total were tested. In addition, this entire process was repeated 4 times to verify repeatability of the results.

As the blanking solution was drawn up as the second fluid in the pipette tip, it was pulled up through the center of the reagent fluid. After one mix cycle, the fluids were fairly mixed, although a lighter region was seen in the center of the pipette tip. After two mixing cycles, the lighter region was less obvious. After the third mixing cycle, the fluid appeared thoroughly mixed. Four mixing cycles would provide assurance that the fluid is fully mixed. Four mixing cycles can be completed in as little as two seconds. Therefore, adequate mixing can be obtained in a reasonable number of mixing cycles.

In another example embodiment of the systems and processes described above, a custom made pipette tip was used to provide fluid samples to an access tube of a microfluidic device. The pipette tip was composed of a normal 10 μL tip with a 2.2 mm diameter, 0.4 mm thick disk glued onto the end of the tip. This added disk provides sufficient surface area for the bead to attach, while preventing the bead from climbing up the outside of the pipette tip.

Using this embodiment, forty consecutive fluid beads, alternating between a clear fluid (a PCR Master Mix) and a blue (xylene cyanol) dyed fluid (a blanking master mix) were delivered to an access tube. Every bead connected correctly with the access tube, even when significant vibrations were introduced into the system. In fact, the system was so repeatable that it was difficult to see any differences between multiple photos that were taken.

Embodiments of the present invention have been fully described above with reference to the drawing figures. Although the invention has been described based upon these preferred embodiments, it would be apparent to those of skill in the art that certain modifications, variations, and alternative constructions could be made to the described embodiments within the spirit and scope of the invention.

What is claimed is:

1. A method for delivering a reaction mixture to a microfluidic chip comprising a docking receptacle, an access tube and a reservoir, the method comprising:

engaging a pipette tip which has docking feature and which contains the reaction mixture, with a reservoir of the microfluidic chip by engaging the docking receptacle of the reservoir with the docking feature of the pipette tip;

producing a bead of the reaction mixture on the exterior of the pipette tip, wherein the bead makes contact with the access tube of the microfluidic chip;

pulling at least a first portion of the reaction mixture from the bead into the access tube of the microfluidic chip while the bead is attached to the pipette tip, wherein the pipette tip comprises a disk attached to a proximal end of the pipette tip to provide additional surface area for the bead to attach; and removing the tip of the pipette from the microfluidic device, wherein a second portion of the reaction mixture remains in the bead externally attached to the pipette tip as it is removed from contact with the access tube of the microfluidic chip, leaving reaction mixture only inside the access tube and not in the reservoir of the microfluidic chip.

2. The method of claim 1, wherein the pipette tip comprises the docking feature and contains the reaction mixture to be delivered, the microfluidic chip comprises the docking receptacle, and the method further comprises engaging the pipette tip with the reservoir of the microfluidic chip via the docking receptacle of the microfluidic chip.

3. The method of claim 2, further comprising removing the docking feature of the pipette tip from engagement with the reservoir of the microfluidic chip.

4. The method of claim 3, wherein following removal of the docking feature of the pipette tip from engagement with the reservoir of the microfluidic chip, there is no air bubble formation in the access tube.

5. The method of claim 2, wherein the docking feature of the pipette tip and the docking receptacle of the microfluidic chip align the pipette tip with the access tube of the microfluidic chip.

6. The method of claim 1, wherein the access tube has a diameter greater than or equal to 50 microns and less than or equal to 200 microns.

7. The method of claim 6, wherein the access tube has a diameter of 100 microns.

8. The method of claim 1, wherein the step of removing the bead from contact with the access tube of the microfluidic chip leaving reaction mixture only inside the access tube and not in the reservoir of the microfluidic chip comprises withdrawing into the pipette the bead of the reaction mixture that was not pulled into the access tube.

* * * * *